US006866581B2

(12) United States Patent
Martinek et al.

(10) Patent No.: US 6,866,581 B2
(45) Date of Patent: Mar. 15, 2005

(54) VIDEO GAMING APPARATUS FOR WAGERING WITH UNIVERSAL COMPUTERIZED CONTROLLER AND I/O INTERFACE FOR UNIQUE ARCHITECTURE

(75) Inventors: Michael G. Martinek, Fort Collins, CO (US); Mark D. Jackson, Fort Collins, CO (US); David R. Kingham, Johnstown, CO (US); Timothy S. Wasinger, Fort Collins, CO (US)

(73) Assignee: IGT, Reno, NV (US)

( * ) Notice: Subject to any disclaimer, the term of this patent is extended or adjusted under 35 U.S.C. 154(b) by 236 days.

(21) Appl. No.: 09/847,051

(22) Filed: May 1, 2001

(65) Prior Publication Data

US 2002/0052230 A1 May 2, 2002

Related U.S. Application Data

(63) Continuation-in-part of application No. 09/405,921, filed on Sep. 24, 1999.

(51) Int. Cl.[7] ..... A63F 9/24
(52) U.S. Cl. ..... 463/16
(58) Field of Search ..... 463/16, 24, 29, 463/41, 42; 273/138.1; 700/1, 11, 19; 709/328, 331, 332; 710/8, 10, 15, 17, 19, 62, 63; 717/1, 3; 326/37, 38

(56) References Cited

U.S. PATENT DOCUMENTS

| | | | | | |
|---|---|---|---|---|---|
| 4,250,563 | A | * | 2/1981 | Struger | 710/63 |
| 4,500,933 | A | * | 2/1985 | Chan | 360/69 |
| 4,683,550 | A | * | 7/1987 | Jindrick et al. | 708/140 |
| 4,972,470 | A | * | 11/1990 | Farago | 713/192 |
| 5,264,958 | A | * | 11/1993 | Johnson | 710/315 |
| 5,398,799 | A | * | 3/1995 | Ranon et al. | 194/216 |
| 5,400,246 | A | | 3/1995 | Wilson et al. | |

(List continued on next page.)

FOREIGN PATENT DOCUMENTS

| | | | | |
|---|---|---|---|---|
| DE | 37 00 861 A1 | | 7/1988 | |
| DE | 40 14 477 A1 | | 7/1991 | |
| EP | 0685246 | | 12/1995 | |
| EP | 0950998 | | 10/1999 | |
| EP | 0953930 | | 11/1999 | |
| GB | 2 072 395 | | 9/1981 | |
| GB | 2072395 | | 9/1981 | |
| GB | 2 201 821 | | 9/1988 | |
| GB | 2 202 984 | | 10/1988 | |
| GB | 2253325 | | 9/1992 | |
| WO | WO-96/14614 | * | 5/1996 | ..... G06F/1/18 |

OTHER PUBLICATIONS

WinSystems, <www.http://webarchive.org/web/19881212034126/–http://winsystems.com/> (Dec. 12. 1998), downloaded from the Internet on Oct. 27, 2003, all pages.*

RTDUSA, <www.http://webarchive.org/web/1990422091026/–http://rtdusa.com/> (Apr.22, 1999), downloaded from the Internet on Oct. 27, 2003, all pages.*

Get Control, Inc., PC–104 DIG–IO–48 Plus, <http://www.getcontrol.com> downloaded from the internet on Mar. 20, 2003, p. 1.*

(List continued on next page.)

*Primary Examiner*—Mark Sager
*Assistant Examiner*—Steven Ashburn
(74) *Attorney, Agent, or Firm*—Marshall, Gerstein & Borun LLP

(57) ABSTRACT

A computerized wagering gaming system and method is disclosed. The system includes a universal computerized game system operable to control a computerized wagering game, including a controller interface and a universal controller for processing an operating system instructions. The system includes game system devices and a game translator system for translating game events between the game system devices and the universal game control system. The controller interface operates as an interface between the universal controller and the game translator system.

21 Claims, 18 Drawing Sheets

U.S. PATENT DOCUMENTS

| | | | | | |
|---|---|---|---|---|---|
| 5,429,361 | A | * | 7/1995 | Raven et al. | 463/25 |
| 5,442,568 | A | * | 8/1995 | Ostendorf et al. | 700/236 |
| 5,444,642 | A | | 8/1995 | Montgomery et al. | |
| 5,473,765 | A | | 12/1995 | Gibbons et al. | |
| 5,497,490 | A | | 3/1996 | Harada et al. | |
| 5,508,689 | A | | 4/1996 | Rado et al. | |
| 5,671,351 | A | | 9/1997 | Wild et al. | |
| 5,688,174 | A | | 11/1997 | Kennedy | |
| 5,702,303 | A | | 12/1997 | Takemoto et al. | |
| 5,707,286 | A | | 1/1998 | Carlson | |
| 5,758,875 | A | | 6/1998 | Giacalone, Jr. | |
| 5,809,329 | A | | 9/1998 | Lichtman et al. | |
| 5,823,874 | A | | 10/1998 | Adams | |
| 5,848,250 | A | | 12/1998 | Smith et al. | |
| 5,848,932 | A | | 12/1998 | Adams | |
| 5,935,224 | A | | 8/1999 | Svancarek et al. | |
| 5,954,583 | A | * | 9/1999 | Green | 463/29 |
| 5,984,786 | A | | 11/1999 | Ehrman | |
| 5,991,546 | A | | 11/1999 | Chan et al. | |
| 6,014,714 | A | * | 1/2000 | Plyler et al. | 710/8 |
| 6,039,645 | A | * | 3/2000 | Mazur | 453/10 |
| 6,044,428 | A | | 3/2000 | Rayabhari | |
| 6,071,190 | A | | 6/2000 | Weiss et al. | |
| 6,117,010 | A | | 9/2000 | Canterbury et al. | |
| 6,126,548 | A | | 10/2000 | Jacobs | |
| 6,134,677 | A | | 10/2000 | Lindsay | |
| 6,135,884 | A | * | 10/2000 | Hedrick et al. | 463/20 |
| 6,222,448 | B1 | | 4/2001 | Beck et al. | |
| 6,263,392 | B1 | | 7/2001 | McCauley | |
| 6,269,474 | B1 | | 7/2001 | Price | |
| 6,279,124 | B1 | | 8/2001 | Brouwer et al. | |
| 6,322,445 | B1 | * | 11/2001 | Miller | 463/13 |
| 6,379,246 | B1 | * | 4/2002 | Dabrowski | 463/16 |
| 6,505,087 | B1 | | 1/2003 | Lucas et al. | |

OTHER PUBLICATIONS

D. Powell et al., GUARDS: a generic upgradeable architecture for real–time dependable systems, Parallel and Distributed Systems, IEEE Transactions on , vol.: 10, Issue: 6 , Jun. 1999, pp. 580–599.*

Robert, A. Burkle, PC/104 Embedded Modules: The New Systems Components, <http://www.winsystems.com/papers/sys_components.pdf> downloaded from the Internet on Mar. 20, 2003, pp. 1–3.*

WinSystems, <www.winsystems.com> downloaded from the Internet on Apr. 2, 2003, pp. 1–25.*

Jim Blazer, PC/104 Intelligent Data Acquisition, PC/104 Embedded Solutions (Spring 1998), pp. 1–2.*

Robert A. Burckle, STD Bus: Performance without Complexity, <http://www.winsystems.com/papers/stdperformance.pdf> (Aug. 1, 2001), pp. 1–3.*

Craig Matasumoto, Intel starts preaching about security, EE Times <http://eetimes.com/story/OEG19990121S0014> (Jan. 21, 1999), pp. 1–4.*

RTD.USA, <www.rtdusa.com> (1998), downloaded from the Internet on Mar. 20, 2003, pp. 1–49.*

Mardsen et al., Development of a PC–Windows Based Universal Control System, 5th Intl. Conf. on FACTORY 2000, Apr., 2–4, 1997 Conf. Pub. No. 435, pp. 284–287.*

Paul Virgo, Embedded PC's for the Industrial Marketplace: An Analysis of the STD Bus, WESCON/'93. Conference Record, Sep. 28–30, 1993, pp. 621–623.*

Jahn Luke et al., A commercial off–the–shelf based replacement strategy for aging avionics computers, Aerospace and Electronics Conference, 1998. NAECON 1998, Proceedings of the IEEE 1998 National , Jul. 13–17, 1998, pp. 177–181.*

A copy of full European Search Report , European Application No. 02253034.9, Search Report mailed Dec. 12, 2003 (3 pgs).

Retro Fitting a Low–Boy Arcade Machine with a Pentium–Powered M.A.M.E. Setup, Oct. 1996, www.cygnus.uwa.edu.au/~jaycole/jaw/arcade.html.

* cited by examiner

VIDEO GAMING APPARATUS FOR WAGERING WITH UNIVERSAL COMPUTERIZED CONTROLLER AND I/O INTERFACE FOR UNIQUE ARCHITECTURE

RELATED APPLICATION

This application is a continuation-in-part of U.S. patent application Ser. No. 09/405,921 filed Sep. 24, 1999, entitled "Video Gaming Apparatus for Wagering with Universal Computerized Controller and I/O Interface for Unique Architecture" which is incorporated herein by reference.

BACKGROUND OF THE INVENTION

1. Field of the Invention

The present invention relates to video gaming equipment, particularly to video gaming apparatus with unique hardware to which a universal computerized controller with a coupling I/O interface is inserted into the video gaming system.

2. Background of the Art

Games of chance have been enjoyed by people for thousands of years and have enjoyed increased and widespread popularity in recent times. As with most forms of entertainment, players enjoy playing a wide variety of games and new games. Playing new games adds to the excitement of "gaming." As is well known in the art and as used herein, the term "gaming" and "gaming devices" are used to indicate that some form of wagering is involved, and that players must make wagers of value, whether actual currency or some equivalent of value, e.g., token or credit.

One popular game of chance is the slot machine. Conventionally, a slot machine is configured for a player to wager something of value, e.g., currency, house token, established credit or other representation of currency or credit. After the wager has been made, the player activates the slot machine to cause a random event to occur. The player wagers that particular random events will occur that will return value to the player. A standard device causes a plurality of reels to spin and ultimately stop, displaying a random combination of some form of indicia, for example, numbers or symbols. If this display contains one of a preselected plurality of winning combinations, the machine releases money into a payout chute or increments a credit meter by the amount won by the player. For example, if a player initially wagered two coins of a specific denomination and that player achieved a payout, that player may receive the same number or multiples of the wager amount in coins of the same denomination as wagered.

There are many different formats for generating the random display of events that can occur to determine payouts in wagering devices. The standard or original format was the use of three reels with symbols distributed over the face of the wheel. When the three reels were spun, they would eventually each stop in turn, displaying a combination of three symbols (e.g., with three wheels and the use of a single payout line as a row in the middle of the area where the symbols are displayed. By appropriately distributing and varying the symbols on each of the reels, the random occurrence of predetermined winning combinations can be provided in mathematically predetermined probabilities. By clearly providing for specific probabilities for each of the preselected winning outcomes, precise odds that would control the amount of the payout for any particular combination and the percentage return on wagers for the house could be readily controlled.

Other formats of gaming apparatus that have developed in a progression from the pure slot machine with three reels have dramatically increased with the development of video gaming apparatus. Rather than have only mechanical elements such as wheels or reels that turn and stop to randomly display symbols, video gaming apparatus and the rapidly increasing sophistication in hardware and software have enabled an explosion of new and exciting gaming apparatus. The earlier video apparatus merely imitated or simulated the mechanical slot games in the belief that players would want to play only the same games. Early video games therefore were simulated slot machines. The use of video gaming apparatus to play new games such as draw poker and Keno broke the ground for the realization that there were many untapped formats for gaming apparatus. Now casinos may have hundreds of different types of gaming apparatus with an equal number of significant differences in play. The apparatus may vary from traditional three reel slot machines with a single payout line, video simulations of three reel video slot machines, to five reel, five column simulated slot machines with a choice of twenty or more distinct paylines, including randomly placed lines, scatter pays, or single image payouts. In addition to the variation in formats for the play of games, bonus plays, bonus awards, and progressive jackpots have been introduced with great success. The bonuses may be associated with the play of games that are quite distinct from the play of the original game, such as the video display of a horse race with 'bets' on the individual horses randomly assigned to players that qualify for a bonus, the spinning of a random wheel with fixed amounts of a bonus payout on the wheel (or simulation thereof), or attempting to select a random card that is of higher value than a card exposed on behalf of a virtual "dealer."

Examples of such gaming apparatus with a distinct bonus feature includes U.S. Pat. Nos. 5,823,874; 5,848,932; 5,836,041; U.K. Patent Nos. 2 201 821 A; 2 202 984 A; and 2 072 395A; and German Patent DE 40 14 477 A1. Each of these patents differ in fairly subtle ways as to the manner in which the bonus round is played. British patent 2 201 821 A and DE 37 00 861 A1 describe a gaming apparatus in which after a winning outcome is first achieved in a reel-type gaming segment, a second segment is engaged to determine the amount of money or extra games awarded. The second segment gaming play involves a spinning wheel with awards listed thereon (e.g., the number of coins or number of extra plays) and a spinning arrow that will point to segments of the wheel with the values of the awards thereon. A player will press a stop button and the arrow will point to one of the values. The specification indicates both that there is a level of skill possibly involved in the stopping of the wheel and the arrow(s), and also that an associated computer operates the random selection of the rotatable numbers and determines the results in the additional winning game, which indicates some level of random selection in the second gaming segment.

U.S. Pat. Nos. 5,823,874 and 5,848,932 describe a gaming device comprising:

a first, standard gaming unit for displaying a randomly selected combination of indicia, said displayed indicia selected from the group consisting of reels, indicia of reels, indicia of playing cards, and combinations thereof; means for generating at least one signal corresponding to at least one select display of indicia by said first, standard gaming unit; means for providing at least one discernible indicia of a mechanical bonus indicator, said discernible indicia indicating at least one of a plurality of possible bonuses, wherein said providing means is operatively connected to said first, standard gaming unit and becomes actuatable in response to said signal. In effect, the second gaming event simulates a mechanical bonus indicator such as a roulette wheel or wheel with a pointing element.

The vast array of electronic video gaming apparatus that is commercially available is not standardized within the industry or necessarily even within the commercial line of apparatus available from a single manufacturer. One of the reasons for this lack of uniformity or standardization is the fact that the operating systems that have been used to date in the industry are primitive. As a result, the programmer must often create code for each and every function performed by each individual apparatus. There have been no available shortcuts, and no manufacturer is known to have even attempted to create a universal system for the existing equipment (such as reusable modules of code) at least in part because of the limitations in utility and compatibility of the operating systems in use. When new games are created, new hardware and software is created from the ground up.

One significant economic disadvantageous feature with commercial video wagering gaming units that maintains an artificially high price for the systems in the market is the use of unique hardware interfaces in the various manufactured video gaming systems. The different hardware, the different access codes, the different pin couplings, the different harnesses for coupling of pins, the different functions provided from the various pins, and the other various and different configurations within the systems has prevented any standard from developing within the technical field. This is advantageous to the apparatus manufacturer, because the games for each system are provided exclusively by a single manufacturer, and the entire systems can be readily obsoleted, so that the market will have to purchase a complete unit rather than merely replacement software, and competitors cannot easily provide a single game that can be played on different hardware.

It is therefore desirable to provide a single video wagering game controller that can be installed in a broad range of video gaming apparatus without substantial modification to the game controller.

SUMMARY OF THE INVENTION

A universal computerized game controller is provided to contain at least some essential operational functions for the play of video wagering games, including, for example, the processing logic and programs necessary to drive such associated aspects of video wagering games such as video imagery, value receipt (i.e. coins, tokens, currency, credit cards, cashless record keeping and player tracking systems, internal credit, etc.), payouts, panel light displays, security systems, service requests (e.g., change, maintenance, refreshments, etc.), jackpot controls and reports, manual operation controls (e.g., buttons, keyboard, joy stick, pressure plate, touch screens, etc.), play instructions, entertainment functions, audio programs, recording functions, history of play functions, random number generator, etc. This computerized game controller is operatively coupled to an Input/Output interface that is matched to pre-existing hardware of a video wagering game system, comprising at least a housing, monitor, value receiving capability, and manual operation controls. By selection of I/O interfaces specific to individually designed video wagering game systems, the universal computerized game controller may be inserted into the video wagering game system to drive the video wagering game system to enable play of a video wagering game controlled by the universal game controller. The I/O interface has at least sufficient matching pin structure with the various hardware of the gaming system so that all necessary signals provided by the computerized game controller will be appropriately routed. The computerized game controller should contain all components necessary for implementation of the play of the video wagering game, except for possibly any segments of the game that may be implemented in user interface hardware attached via the I/O interface. The ability to provide a universal computerized game controller for a specific game or series of games (e.g., a selection from among a number of games such as is provided on multi-game video programs or on video wagering games in casinos) that can be inserted into any existing video wagering game apparatus enables facilitated recycling of gaming systems and the closest enablement of a standard for the applicability of wagering game programs to the diverse gaming system hardware in the gaming industry. This type of system will enable the significant reduction of costs in providing new games to casinos, since the computerized game controller and I/O interface can be provided with all of the necessary control function to drive a new wagering game, without the need to reprogram the game controller.

In another embodiment, the present invention provide a computerized wagering gaming system and method. The system includes a universal computerized game system operable to control a computerized wagering game, including a controller interface and a universal controller for processing game and operating system instructions. The system further includes game system devices and a game translator system for translating game events between the game system devices and the universal game control system. A controller interface operates as an interface between the universal controller and the game translator system.

DETAILED DESCRIPTION OF THE INVENTION

Typical gaming systems comprise a variety of user interface devices or peripheral devices that allow a user to interact with a game of chance that is comprised of software being executed by a computerized game controller. For example, a user may use push buttons, a joystick, a pull lever or arm, or a touch screen to input information to the computerized system, and the computerized system may respond via lights or a video display to indicate the status of the game. Because gaming as defined for purposes of this application involves wagering value, devices such as token, money, or credit receiving devices and return devices will allow a user to establish credited value to be wagered in the course of the game and to cash out when play is completed. Other peripheral devices may include security devices such as tilt switches, apparatus security switches, cashless ticketing systems and cashless printout systems, or other devices designed to ensure integrity of the gaming apparatus. Still other devices are implemented in various games to allow further interaction between the user and the gaming system, and may be connected to the computerized game controller that controls the operation of the gaming system.

When a new game is developed, typically a new gaming system including a custom peripheral interface assembly must be developed to support the game. The game itself is often provided as a computer program executable on a computerized game controller, which is attached via unique connection interfaces to the various interface peripheral devices necessary to facilitate interaction between the computerized system, the user and other devices such as the casino computer. Because these interfaces are not standard, but vary between manufacturers and even between gaming systems produced by the same manufacturer, production of new games requires reprogramming of the game to communicate with each unique gaming system.

The present invention provides an I/O (Input/Output) interface configured to couple a user interface assembly of interface peripheral devices to a communication port of a general purpose computer serving as a computerized game controller. By connecting the unique user interface assemblies of various existing gaming systems to a computerized game controller via various I/O interfaces and custom wiring harnesses, the invention provides a means of using a common computerized game controller to implement a game usable with a variety of existing gaming systems with different user interface assemblies.

Figure 1:
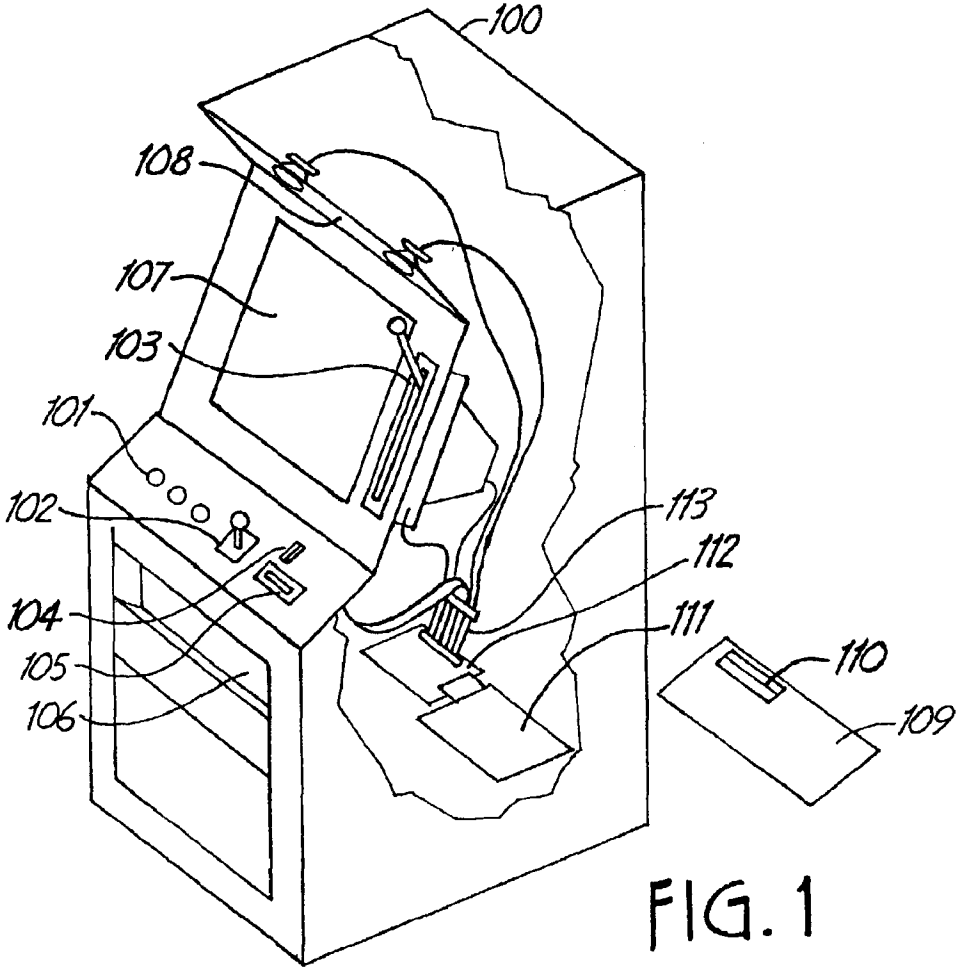
FIG. 1 shows a gaming system with a variety of user interface peripheral devices supporting an embodiment of the invention.

FIG. 1 shows an exemplary gaming system 100, illustrating a variety of components typically found in gaming systems and how they may be used in accordance with the present invention. User interface devices in this gaming system include push buttons 101, joystick 102, and pull arm 103. Credit for wagering may be established via coin or token slot 104, a device 105 such as a bill receiver or card reader, or any other credit input device. A card reader 105 may also provide the ability to record credit information on a user's card when the user has completed gaming, or credit may be returned via a coin tray 106 or other credit return device. Information is provided to the user by devices such as video screen 107, which may be a cathode ray tube (CRT), liquid crystal display (LCD) panel, plasma display, light-emitting diode (LED) display, or other display device that produces a visual image under control of the computerized game controller. Also, buttons 101 may be lighted to indicate what buttons may be used to provide valid input to the game system at any point in the game. Still other lights or other visual indicators may be provided to indicate game information or for other purposes such as to attract the attention of prospective game users. Sound is provided via speakers 108, and also may be used to indicate game status, to attract prospective game users, or for other purposes, under the control of the computerized game controller. It is anticipated that a variety of other user interface peripheral devices will be developed, and are to be considered within the scope of interface devices that comprise an interface assembly. These other devices are therefore to be considered within the scope of interface devices compatible with and intended to be used with the present invention.

The gaming system 100, as is consistent with the prior art, further comprises a computerized game controller 109 that comprises software and hardware that controls the interface peripheral devices via one or more electrical connectors such as electrical connector 110. But, because the format of these connectors such as connector 110 varies from gaming system to gaming system, and generation of separate computerized gaming controllers for each common interface format is expensive and inefficient, the present invention replaces the prior art system-specific computerized game controller 109 with a novel universal computerized game controller 111 and I/O interface 112. The universal game controller 111 need not have its software or hardware redesigned to conform to the interface requirements of various gaming system user interface assemblies, but can be designed once and can control various gaming systems via I/O interfaces 112 designed to properly interface an input and/or output of the universal computerized game controller to the interface assemblies found within the various gaming systems.

In some embodiments, the universal game controller 111 is a standard IBM Personal Computer-compatible (PC compatible) computer. Still other embodiments of a universal game controller comprise general purpose computer systems such as embedded controller boards or modular computer systems. Examples of such embodiments include the PC/104 PC-compatible computer system, which is an example of a modular computer system that features a compact size and low power consumption while retaining PC software and hardware compatibility. The universal game controller provides all functions necessary to implement a wide variety of games by loading various program code on the universal controller, thereby providing a common platform for game development and delivery to customers for use in a variety of gaming systems. Other universal computerized game controllers consistent with the present invention may include any general-purpose computers that are capable of supporting a variety of gaming system software, such as universal controllers optimized for cost effectiveness in gaming applications or that contain other special-purpose elements yet retain the ability to load and execute a variety of gaming software.

The universal computerized game controller of some embodiments is a computer running an operating system with a gaming application-specific kernel. In further embodiments, a game engine layer of code executes within the kernel, further providing common game functionality to the programmer. The program in such embodiments is therefore only a fraction of the total code, and relies on the game engine layer and gaming kernel to provide commonly used gaming functions. Still other embodiments will have various levels of application code, ranging from embodiments containing several layers of game-specific code to a single-layer of game software running without an operating system or kernel but providing its own computer system management capability.

The I/O interface 112 in some embodiments is a device comprising circuitry necessary to convert various signals between the interface formats supported by the interface assembly and the universal controller. Such circuitry may encode various signals, may convert signals from one voltage level to another or invert signals, may multiplex or decode various signals, or may perform any other similar function necessary to convert signals between formats supported by the various interface assemblies and the universal computerized game controller. In further embodiments, the I/O interface comprises digital logic to perform functions such as buffering, latching signals, or converting signals between various protocols. In some embodiments, a wiring harness 113 may be further used to provide connectors compatible with connectors of the interface assembly to interface the interface devices to the I/O interface. The wiring harness in some embodiments comprises conductors coupled to a connector that mates with a connector on the I/O interface 112, and one or more connectors of various types coupled to the other end of the conductors to mate with the unique connectors of the particular user interface assembly for which the wiring harness and I/O interface are designed.

In other embodiments, the I/O interface comprises an I/O port that is common to all interface assemblies, coupled to an application-specific I/O interface portion that performs the format conversion, buffering, or other functions needed to facilitate communication between the interface formats of the user interface assembly and the I/O port. In some embodiments, the I/O port is a standard port such as an RS-232 port (also known as a PC-compatible serial port) or other PC-compatible standard data I/O port. In still other embodiments, the I/O port is a port requiring the application-specific I/O interface portion have more advanced communication capability, such as a Universal Serial Bus (USB) port. In such embodiments, the application-specific I/O interface portion both converts signals received from and sent to the interface assembly devices to the proper format, but also encodes all information for transmittal over the I/O port such as the USB port. In further embodiments, for example, all peripheral devices of the interface assembly may be addressed by the game program as a single USB device, or the I/O interface may allow addressing of each of many peripheral devices as separate USB devices. Such embodiments are beneficial because they simplify coding of the actual game by allowing use of standard USB communication protocol commands to communicate with the various peripheral devices.

I/O interfaces consistent with the present invention may include both event-driven I/O and polled I/O, as well as any other method of I/O handling that facilitates communication between the universal computerized game controller and the peripheral devices of the user interface assembly. It is anticipated that various combinations of I/O interface hardware, wiring harnesses, and universal computerized game controller I/O port formats exist and are yet to be developed, all of which are considered to be within the scope of the present invention.

In some embodiments, certain user interface peripheral devices may be driven directly by the universal computerized game controller or by various special-purpose interface components attached thereto. For example, a composite video signal may be provided directly to a CRT by the universal computerized game controller rather than sent via the I/O interface to a wiring harness to link the CRT to the controller. Support for other video display devices may then be provided by using various display adapters as special-purpose interface components attached to the universal computerized game controller.

The present invention provides a computerized wagering game apparatus, comprising a general purpose computer operable to control a computerized wagering game. A video display device displays a visual representation of a signal provided by the general purpose computer such that the video display device displays at least one visual image which is either computerized wagering game status information or symbol elements that change with the play of the wagering game. A communication port is communicatively coupled to the general purpose computer, and is connected to a user interface assembly comprising one or more user interface devices. The connection is made via an interface adapter configured for the specific interface assembly to be connected to the general purpose computer.

The computerized wagering game apparatus preferably uses as the general purpose computer an IBM PC-compatible computer system. The general purpose communication port preferably is selected from the group consisting of a PC serial port, PC parallel port, and a PC104 port. At least one of the user interface devices preferably is selected from the group consisting of buttons, slot machine arms, touch screen coordinates, joy sticks, credit management devices, coin acceptors, coin recognition systems, currency acceptors, currency recognition systems, cashless wagering systems (including ticket printers and magnetic card reader/printers) and credit card readers. At least one of the user interface devices may comprise a security device, such as tilt switches, device integrity switches door open detectors, and spurious electrical discharge detectors.

A method for practicing the present invention would include reconfiguring a computerized wagering game apparatus having a harness for associating the universal game controller and memory with output devices in the apparatus, the method comprising:

a) removing original computer architecture used to control a computerized wagering game from the apparatus, the original architecture comprising a mother board that has been designed for a specific gaming machine and a harness that has been designed for a unique gaming machine;

b) inserting a universal motherboard (i.e., universal game controller) having memory of a video wagering game that can be played on the video wagering game apparatus and an I/O device compatible with the harness; and c) sending signals from the motherboard through the I/O and harness to confirm communication between the motherboard and the output devices.

In the method, after sending the signals, the video gaming apparatus enables a video display device associated with the video wagering game apparatus to provide a visual representation of a signal provided by the motherboard such that the video display device displays at least one visual image selected from the group consisting of a) computerized wagering game status information and b) symbol elements that change with the play of the wagering game;

a general purpose communication port communicatively coupled to the general-purpose computer;

a interface assembly comprising one or more user interface devices; and an interface adapter configured to communicatively couple the interface assembly to the general purpose communication port.

It is well within the skill of those in the video wagering game art to construct motherboards, particularly PC motherboards (e.g., with Intel 8086-compatible processors, memory, and nonvolatile storage such as EPROM or disk storage), for the enablement of a video wagering game with controls over at least video graphics, value control, manual operation control, and game element control. However, these motherboards, although they can be designed and constructed possessing universal capability of driving the complete play of a video wagering game are not automatically compatible with all available video wagering game hardware and apparatus. Each company has its own unique apparatus, with its own harness system, pin systems and the like. In fact, some major manufacturers have a number of incompatible harness systems and pin systems within their own product lines. According to the present invention, individual I/O devices, each with pinning appropriate to each video wagering game apparatus, are provided with the universal motherboard with at least one video wagering game embedded therein and the universal motherboard and I/O device are used to replace the mother board and memory devices in the video wagering game apparatus so that the video wagering game can be played on the video wagering game apparatus. The I/O component may be supplied separately from the universal motherboard, and the two connected during installation of the game into the video wagering game apparatus, or the motherboard and I/O device may be preconnected (e.g., prepackaged) for use with specifically designated video wagering game apparatus.

It is also a preferred operation of the practice of the present invention to provide the personal computer used in the practice of the present invention with a UNIX-derived operating system, such as Linux. Linux is an operating system that was initially created as a hobby by a young student, Linus Torvalds, at the University of Helsinki in Finland. Linus had an interest in Minix, a small UNIX system, and decided to develop a system that exceeded the Minix standards. He began his work in 1991 when he released version 0.02 and worked steadily until 1994 when version 1.0 of the Linux Kernel was released. The current full-featured version is 2.2 (released Jan. 25, 1999), and development continues. Linux is developed under the GNU General Public License and its source code is freely available to everyone. This however, doesn't mean that Linux and its assorted distributions are free—companies and developers may charge money for it as long as the source code remains available. Linux may be used for a wide variety of purposes including networking, software development, and as an end-user platform. Linux is often considered an excellent, low-cost alternative to other more expensive and less flexible operating systems. Due to the very nature of Linux's functionality and availability, it has become quite popular worldwide and a vast number of software programmers have taken Linux's source code and adapted it to meet their individual needs. At this time, there are dozens of ongoing projects for porting Linux to various hardware configurations and purposes.

The central nervous system of Linux is the kernel, the operating system code which manages the whole computer. The kernel is under constant development and is always available in both the latest stable release and the latest experimental release. Progress on development is very fast, and the recent 2.2-series kernels are extremely efficient relative to competitive software. The kernel design is modular, so that the actual OS code is very small yet able to load whatever functionality it needs when it needs it, and then free the memory afterwards. Because of this, the kernel remains small and fast yet highly extensible, in comparison to other operating systems which slow down the computer and waste memory by loading everything all the time, whether you need it or not.

Linux systems excel in many areas, ranging from end user concerns such as stability, speed, and ease of use, to serious concerns such as development and networking. Nowadays, Linux even offers a variety of commercial productivity packages and office suites which can import and export files from other platforms, including Windows and MacOS.

Linux has long been praised for its stability—Linux systems are known for running months or even years at a time without crashing, freezing, or having to be rebooted. Linux is Y2K-compliant, because it stores the date in a different way from other computers (its trouble date is 2038, by which time a small modification to the kernel should have solved the problem). Also, because it is extremely secure compared to other platforms, viruses for Linux essentially do not exist. Linux machines are also known to be extremely fast, because the operating system is very efficient at managing resources such as memory, CPU power, and disk space. More of the Internet's World Wide Web than one might expect is actually powered by old 486 systems running Linux and the Apache web server, while NASA, Scandia, Fermilabs and others have built very powerful yet inexpensive supercomputers by creating clusters of Linux boxes running in parallel.

As for an intuitive graphical interface, Linux has at least a dozen different highly configurable graphical interfaces (known as window managers) which run on top of XFree86, a free implementation of the X Window System. The most popular window managers at the moment are KDE (the K Desktop Environment) and GNOME (the GNU Network Object Model Environment). These offer the point-and-click, drag-and-drop functionality associated with other graphical interface user-friendly environments (for example, Macintosh), but are extremely flexible and can take on a number of different looks and feels. Today, even complex tasks like system administration, package installation, upgrading, and network configuration can all be done very easily through graphical programs. Programs that work with one window manager nearly always work with all the others. While such graphical user interfaces will likely not be presented to a game system user in a casino environment, they facilitate programming and testing of game software, easing the burden of developing and testing new gaming software.

Programmers often find that the Linux development environment is second to none—a good thing for end users who depend on these software developers to provide free software. Nearly all development software for Linux is free and covered under the GNU Public License, which guarantees that it will always remain free. Linux systems come standard with C and C++ compilers and an assembler, and often include Pascal, FORTRAN, and BASIC implementations as well. In addition, modern languages like Perl and Python and classic languages like LISP are all available, fully functional and completely free. In addition, the source code for nearly any Linux program is freely available (and often included by default). This not only means that bugs are discovered and corrected almost immediately, but development of software proceeds at a much faster pace than one finds even at extremely successful commercial software houses. This phenomenon is called Open Source and is the subject of much discussion and amazement in the business world, the computer world, and the press.

Networking comes naturally to Linux. After all, Linux is based on UNIX, where much of computer networking technology was developed. Almost all common networking protocols in use on the Internet are native to UNIX and/or Linux, so one can expect that UNIX and Linux would network better than any other platforms. Setting up a network on a Linux machine is surprisingly simple, because Linux handles most of the work; you just have to give it the correct addresses. Linux is made for networking. A large part of the Web is running on Linux-based systems.

The preferred operating systems for use in the present invention includes game application code written to be executed in the LINUX operating system, which can operate on a standard personal computer. Using LINUX, even the code for a specific game can be segregated into discrete reusable components that can be reused for virtually any game. Such code segregation cannot be performed in a similar manner with current gaming operating systems. This will assist enabling the more rapid introduction of games with shorter turn-around times, shorter field trials, greater stability of new gaming applications, and less independent development of software for each new game.

A commercially available motherboard (e.g., from a 386 PC through current commercial motherboards of 650 MHZ Pentium III, 1000 MHZ Pentium IV and whatever newer systems become available) is provided with hardware (an I/O device) that enables the commercial motherboard programmed with the game software to communicate with non-standard wiring harnesses. The I/O interface permits communication between the standard ports of a standard motherboard and non-standard pin connections provided in the non-standard harness. It is also an aspect of the present invention to interrogate user interface components of a computerized gaming system through the I/O interface, to determine the characteristics of attached devices.

As with known software used to interconnect peripherals with computers during installation, signals are sent from the personal computer through ports, attempting to communicate with the peripheral, primarily to identify the nature of the peripheral (e.g., a printer, a monitor, network connection, cashless systems, scanner, etc.). A signal is sent through the port (which can be considered in the practice of this invention equivalent to a pin-to-function connection through the I/O interface) to the peripheral, and the response from that peripheral can and will identify the nature of the peripheral (including brand, model, identification number, etc.) and the software in the motherboard will configure output for that port (or in the present invention, through a pin) to properly communicate with that peripheral. In the present invention, the universality of the motherboard is enhanced by such interrogatory software that will interrogate the video wagering game hardware through the I/O interface to assure that appropriate communication is being sent through each pin. For example, a signal sent through a pin will identify the pin(s) for the video monitor, the pin(s) for the coin acceptor, LED screen connecting pin(s), audio output, speaker pin(s), security peripheral pin(s), and any secondary display system pin(s), the pin(s) for currency identification, the pin(s) for hopper control, the pin(s) for coin comparators, pin(s) for the button panel, pin(s) for touch screen controls, pin(s) for any progressive jackpot controller, pin(s) for player tracking and history recordation, pins for cashless transactions, pins for ticket printing and pins for magnetic ticket printing, pin(s) for network connections, and the like. In this manner, merely inserting a pin connection (through the I/O interface) that makes communication contact with each required function of the video wagering gaming software, even without initial programmed specific identification of the propriety of specific pin connections, the software can identify the ultimate peripheral function for each pin or identify the user interface assembly being utilized and configure the signal courses appropriately from the computerized controller.

One limiting control on the use of this invention, which can be readily addressed, is the fact that gaming authorities require devices to store at least certain programs on EPROM chips mounted on the motherboard. If a standard personal computer motherboard is used in the practice of the present invention, an EPROM chip would probably have to be mounted onto a daughter board and connected to the motherboard to assure gaming law compliance. Still other embodiments may incorporate hard disk drives that are hardware-configured to be read-only, or other nonvolatile storage devices designed to comply with applicable regulations.

It is also desirable to select an industrial motherboard, as compared to a commercial motherboard, but primarily as a preferred, not essential characteristic in the practice of the present invention. Industrial motherboards are more sturdy, designed for twenty-four hour a day operation, resist impact stress, are more heat tolerant, and are vibration resistant. The chips in industrial motherboards tend to have longer end-of-life durability, designed to perform for 5 to 6 years, as opposed to the minimum requirement of six month end-of-life periods for home PC's. Industrial motherboards also tend to be more compact, and are also often provided with built-in or modular peripherals, such as sound chips, video processing cards, volatile memory, and Ethernet connection cards. Standard PC motherboards are also adaptable to new technology via upgrades, which is not possible with the non-standard control systems provided in present day commercial video wagering game apparatus. By using a standard PC-based system, the peripherals could also be more easily standardized. A typical industrial motherboard suitable for practice of the present invention would be an Advantech PCM5862E PC/104 motherboard.

There are at least three different configurations of I/O adapters contemplated in the practice of the present invention. A first, simplest design board comprises two interconnected boards. A first board would be, for example only, and off the shelf transistor-transistor logic (TTL) board that would plug into a bus (e.g., PC 104 bus) on a motherboard. Preferably the TTL board would interface with another proprietary board to provide enhanced signals, as the TTL board would be capable of providing only TTL signals. These first and second boards would be connected with a ribbon, for example only, a ribbon with a 50-pin connector attached thereto. The second board modifies the TTL signals by adjusting the voltage of the signals and routes the signals to the appropriate pins. The signal amplification, especially for peripherals such as light controls, panel controls, and hopper control are important. The second board could and should also include buffers that would protect the motherboard from external assault.

A second format of motherboard-I/O board configuration would combine the circuitry of the two boards described above into a single board. This would require the construction of a single passive adapter board that would be more expensive to construct, design and manufacture, but would be smaller, providing a smaller footprint than the combined boards of the first format. All of the described functions of the first format would still be provided in this second format of board. The pin connection would be a separate component and unique to each individual harness.

A third format of the motherboard-I/O board configuration of the present invention would provide a motherboard connected (plugged in, for example) to a Universal Serial Bus (USB) rather than the PC 104 bus. A single cable (e.g., at least 4, 6, 8 or more wires cable) connects the motherboard to the I/O board and to the individual peripherals. In this manner, the I/O board has the capability of being intelligent, with its own memory components in addition to that of the mother board, because it is in serial communication between the motherboard and the harness. This would enable the provision of the interrogatory functions described above. Pin configurations specific to each known gaming machine (which knowledge can be updated because if the use of the personal computer system) could be stored in the operating system, and the board could then sense (interrogate) any machine to which it has been connected and to initialize correct pin configuration software or even reconfigure software for anomalous configurations or connections, thereafter associating signals with the correct peripheral. Although the use of a common, reusable controller such as a PC104 system is itself a major advance on the practice in the field, the use of a USB, being smaller and having fewer pin connections, would further improve the reliability of the system.

Figure 2:
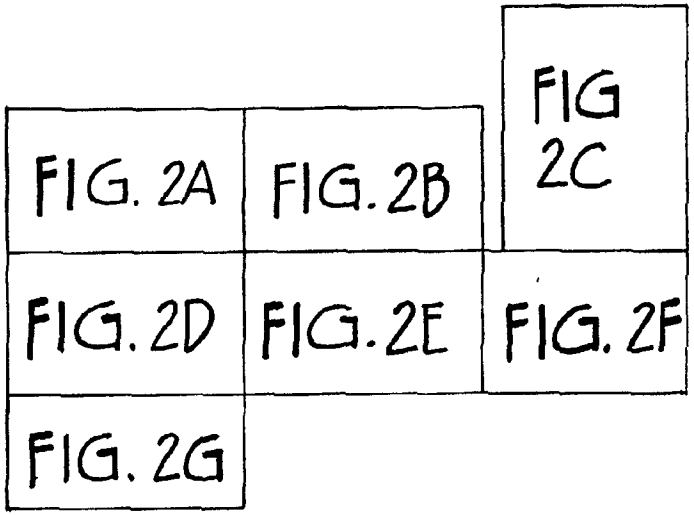
FIG. 2 provides schematic of an I/O board designer/manufacture with all of the technical specifications that would be needed for constructing a unit specific I/O board.
Figure 2G:
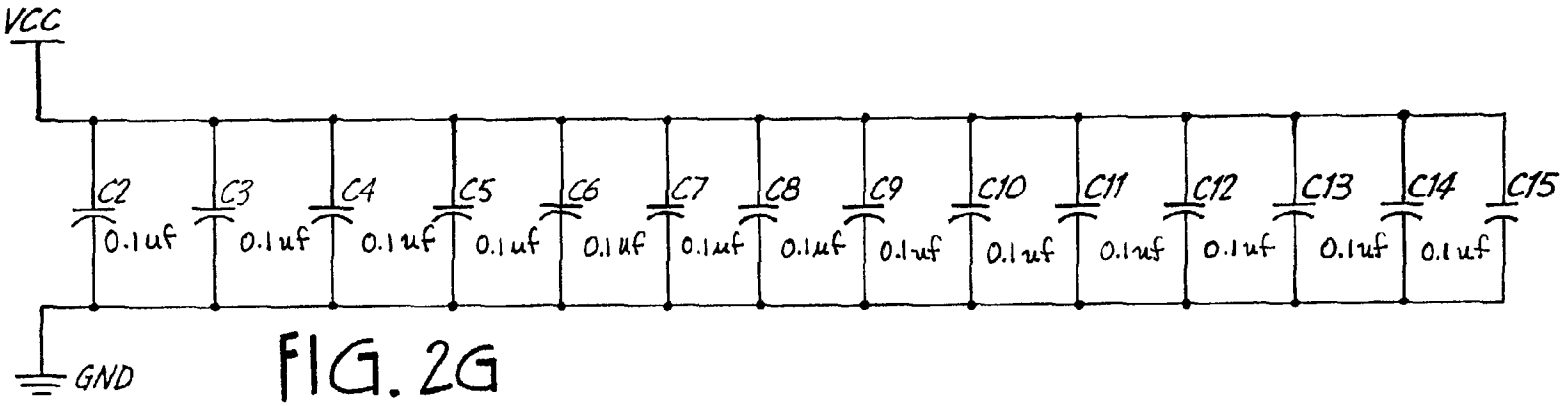
Figure 2A:
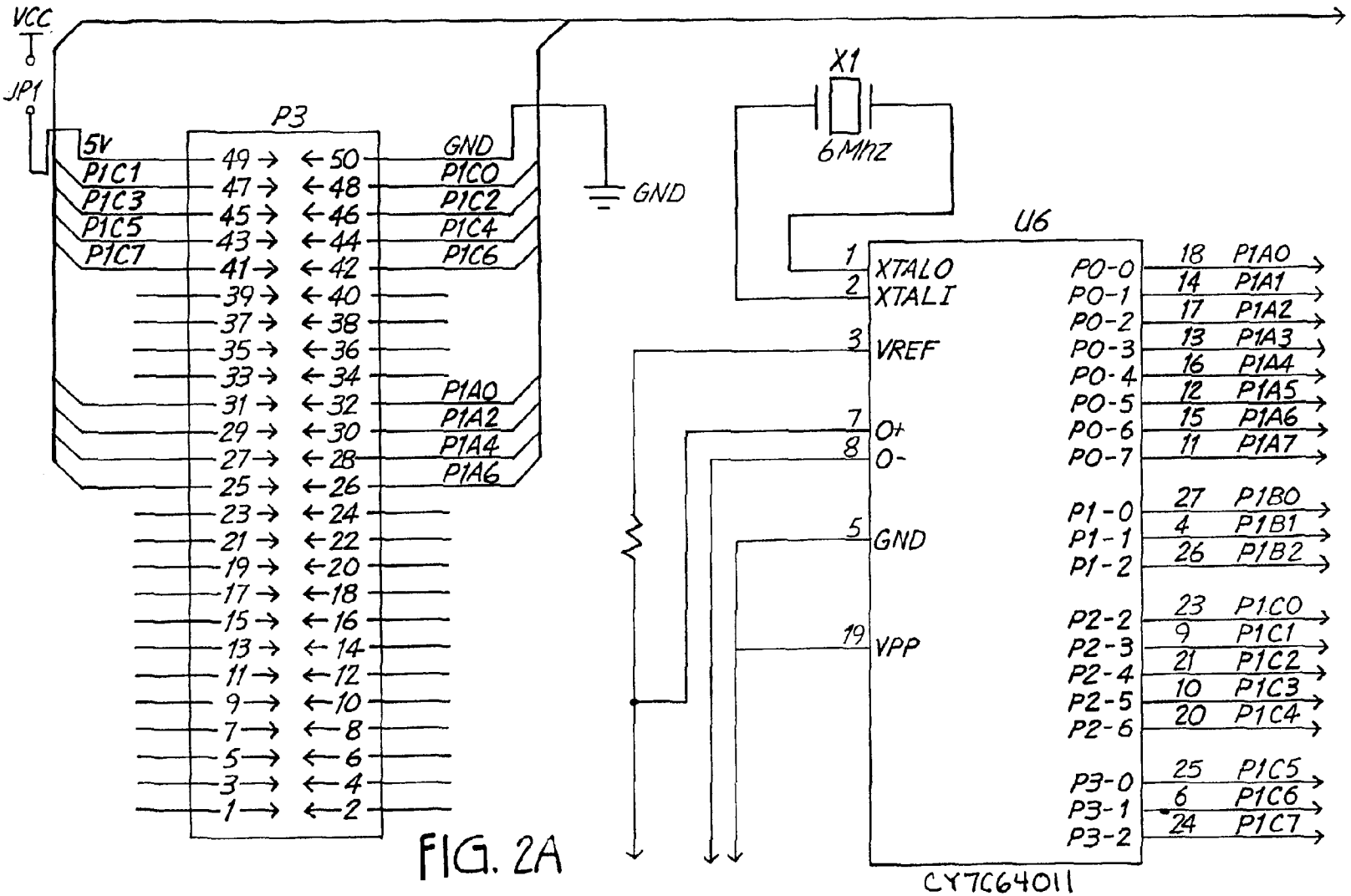
Figure 2B:
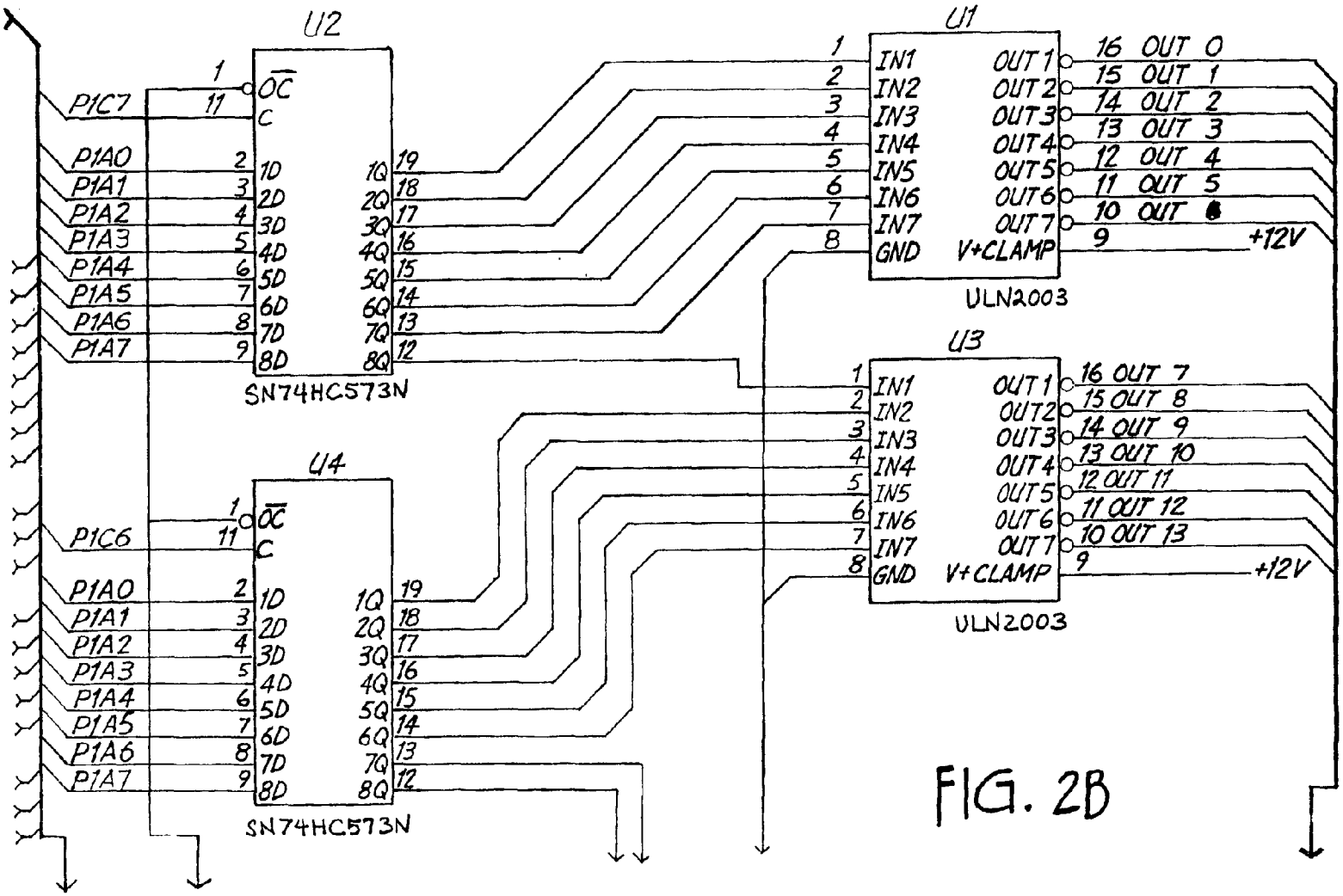
Figure 2C:
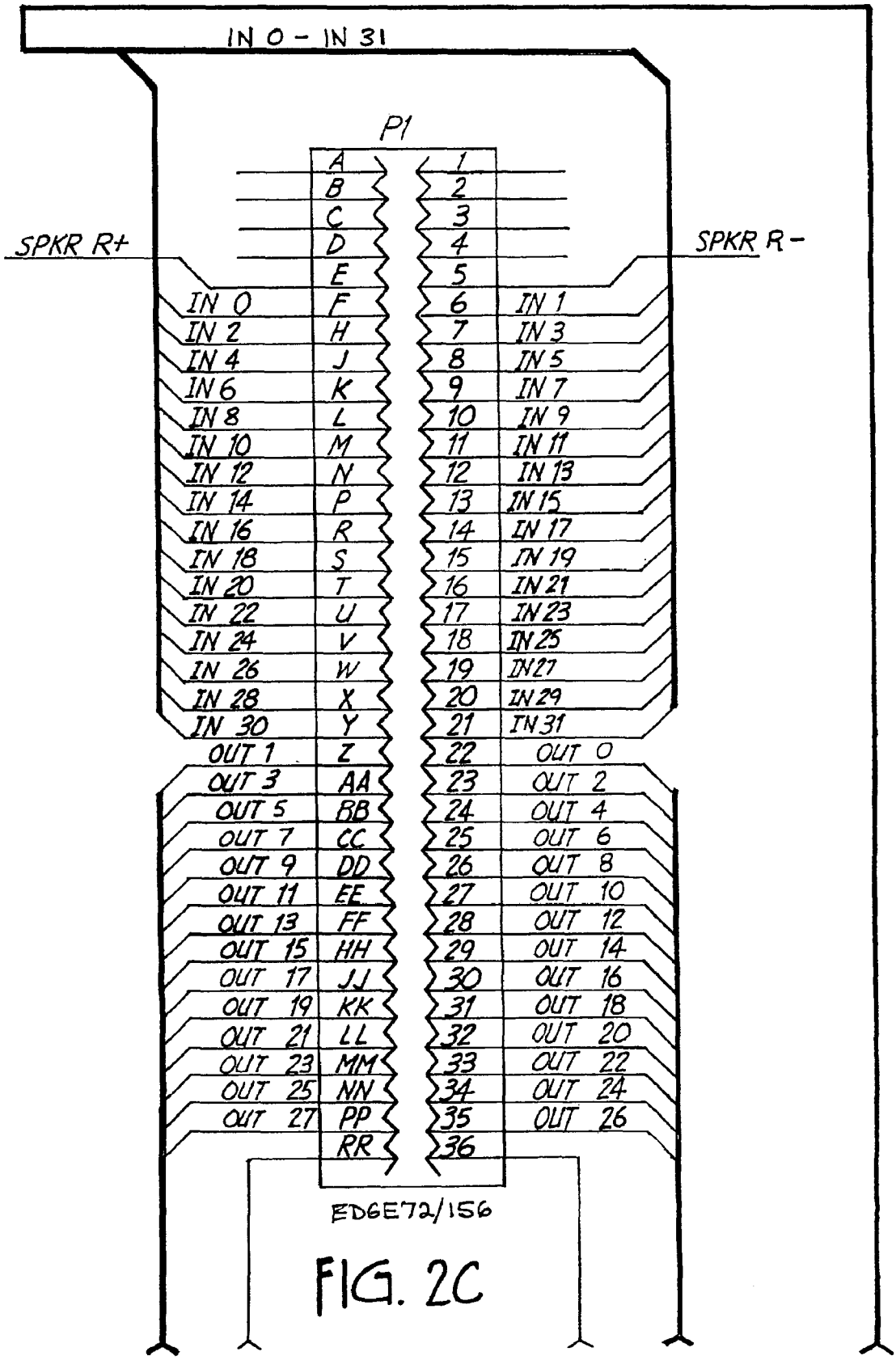
Figure 2D:
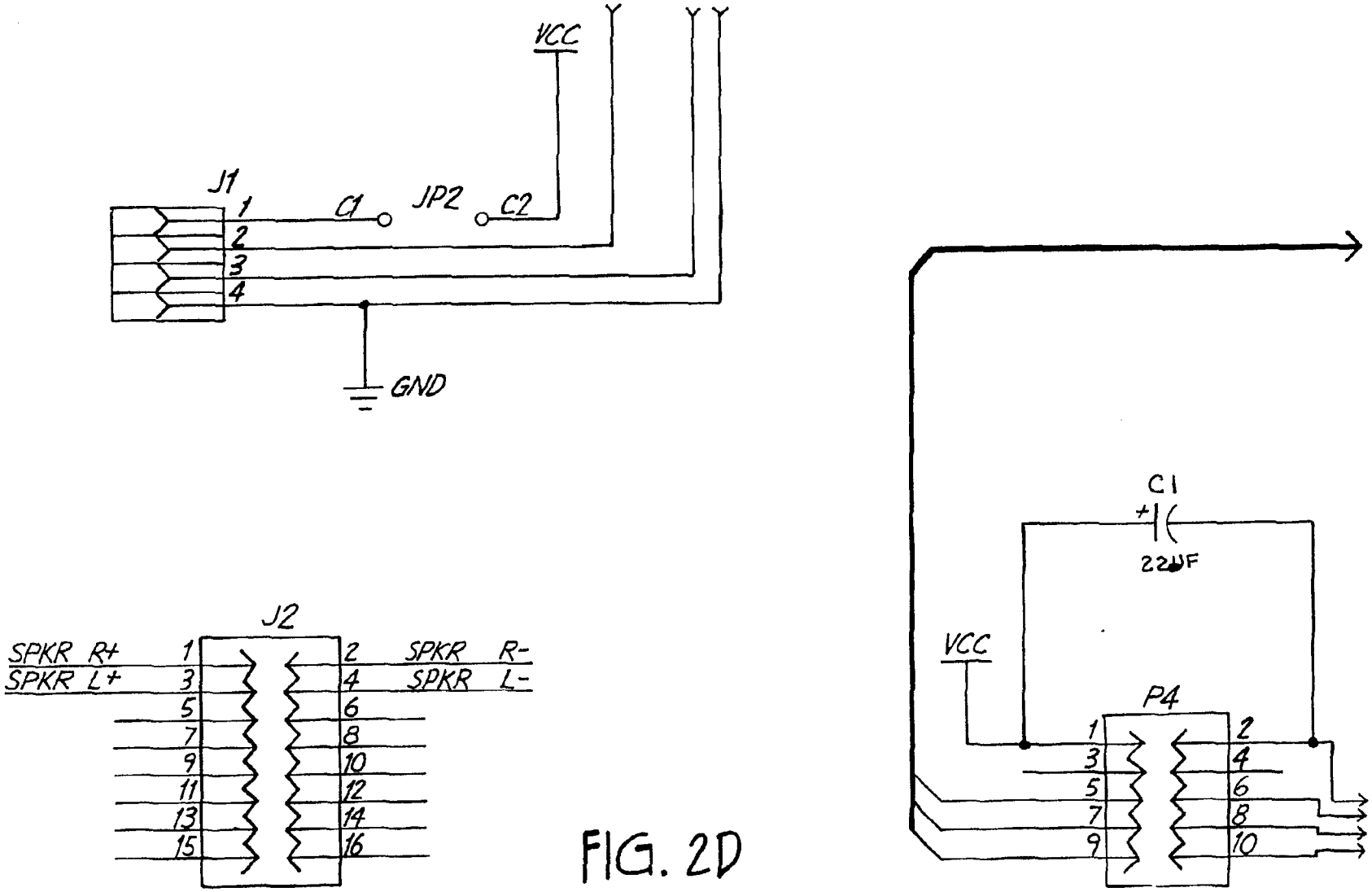
Figure 2E:
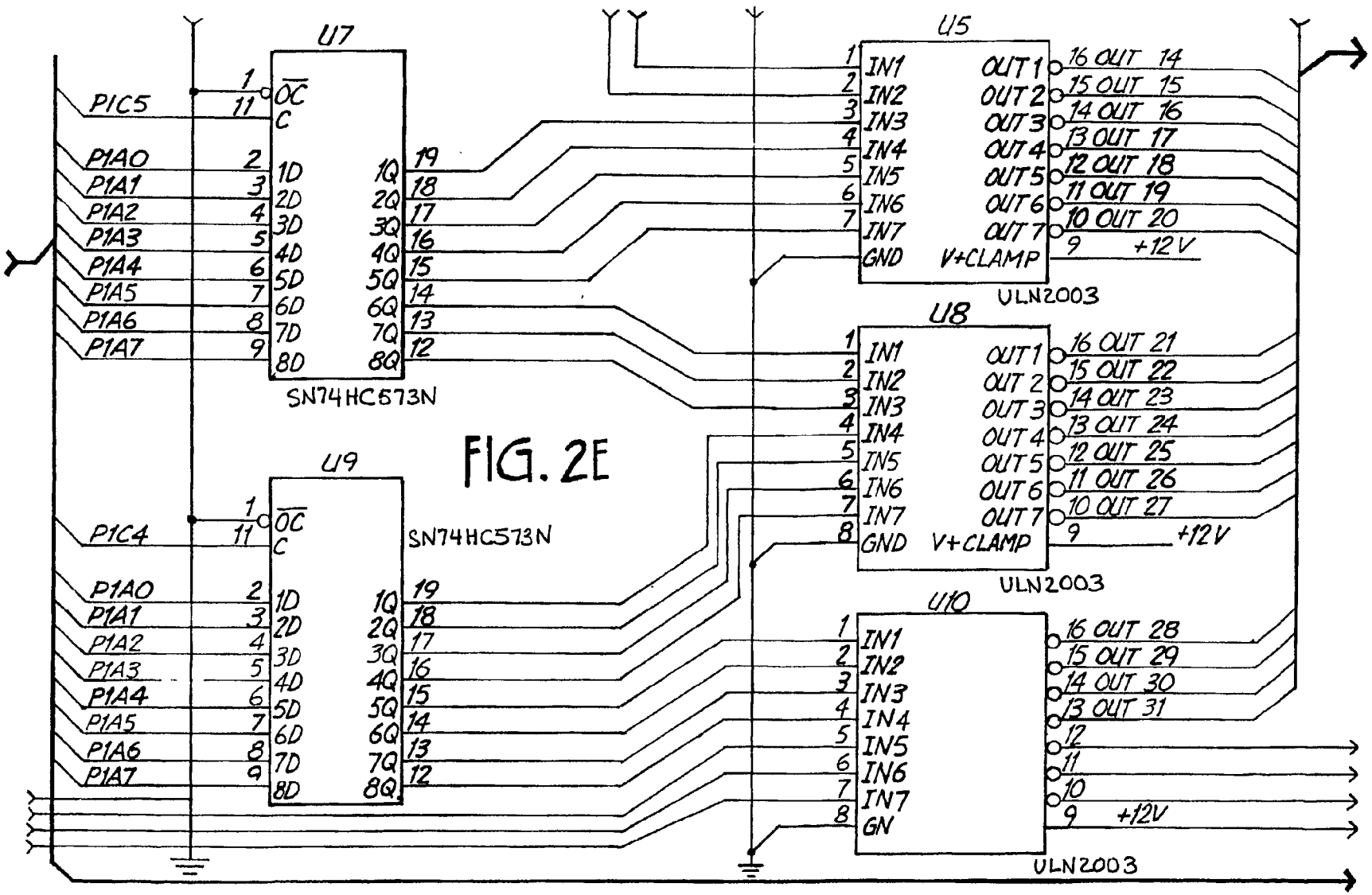
Figure 2F:
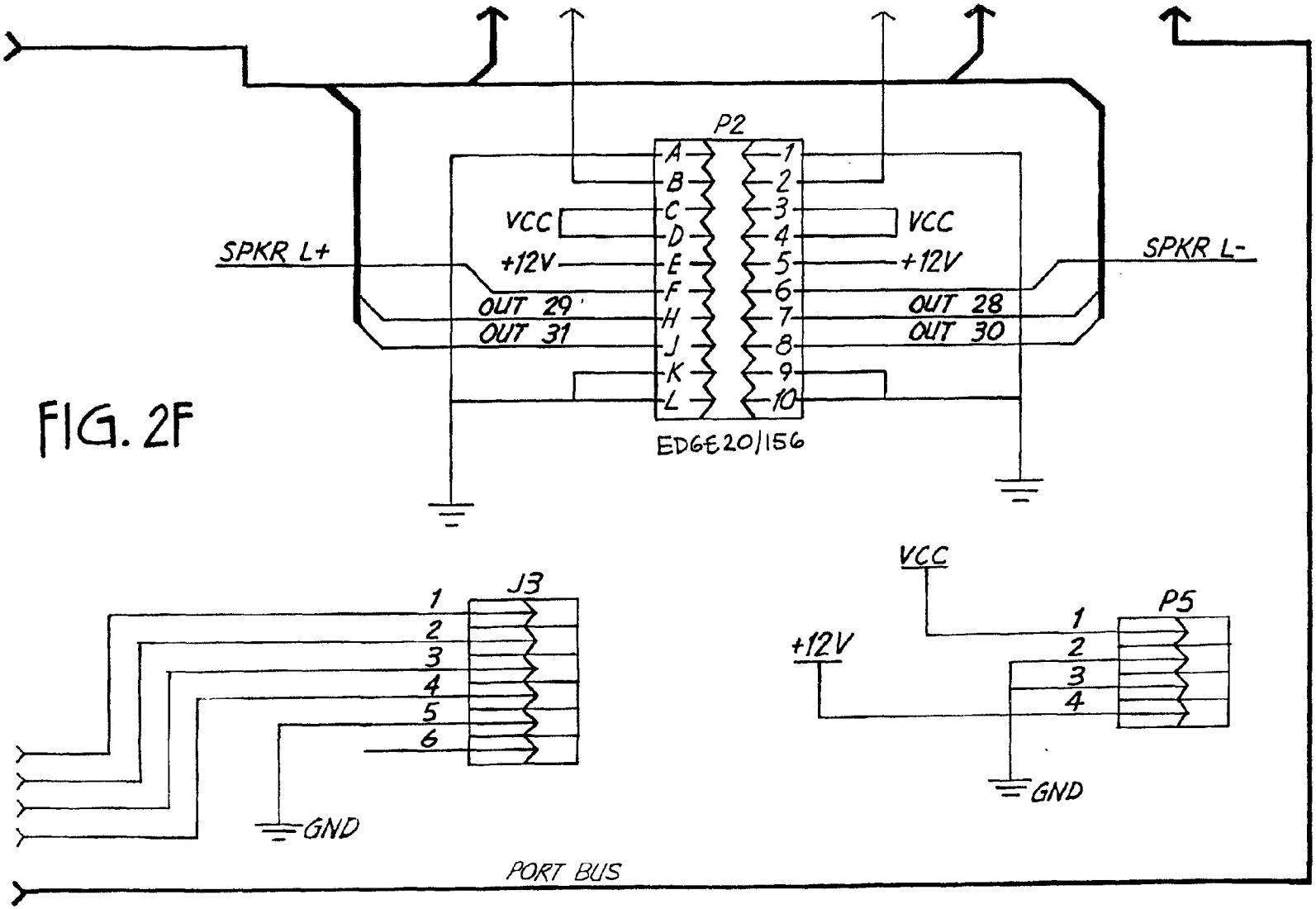

Each apparatus-specific I/O interface is designed by first evaluating the required pin configuration for each video wagering game apparatus into which a new or upgraded game is to be installed. It is well within the skill of the artisan to externally or electronically identify pins that provide specific functions, such as inputs, outputs and power. The voltage or other signal characteristics required through each pin would then be determined. Based upon the mapped type of signals to be delivered and the mapped configuration of the pins, a circuit diagram, such as that shown in FIG. 2 could be created. This diagram in FIG. 2 provides an I/O board designer/manufacture with all of the technical specifications that would be needed for constructing a unit specific I/O board. The diagram of FIG. 1 happens to be the specific configuration for a Cole cabinet.

Figure 3:
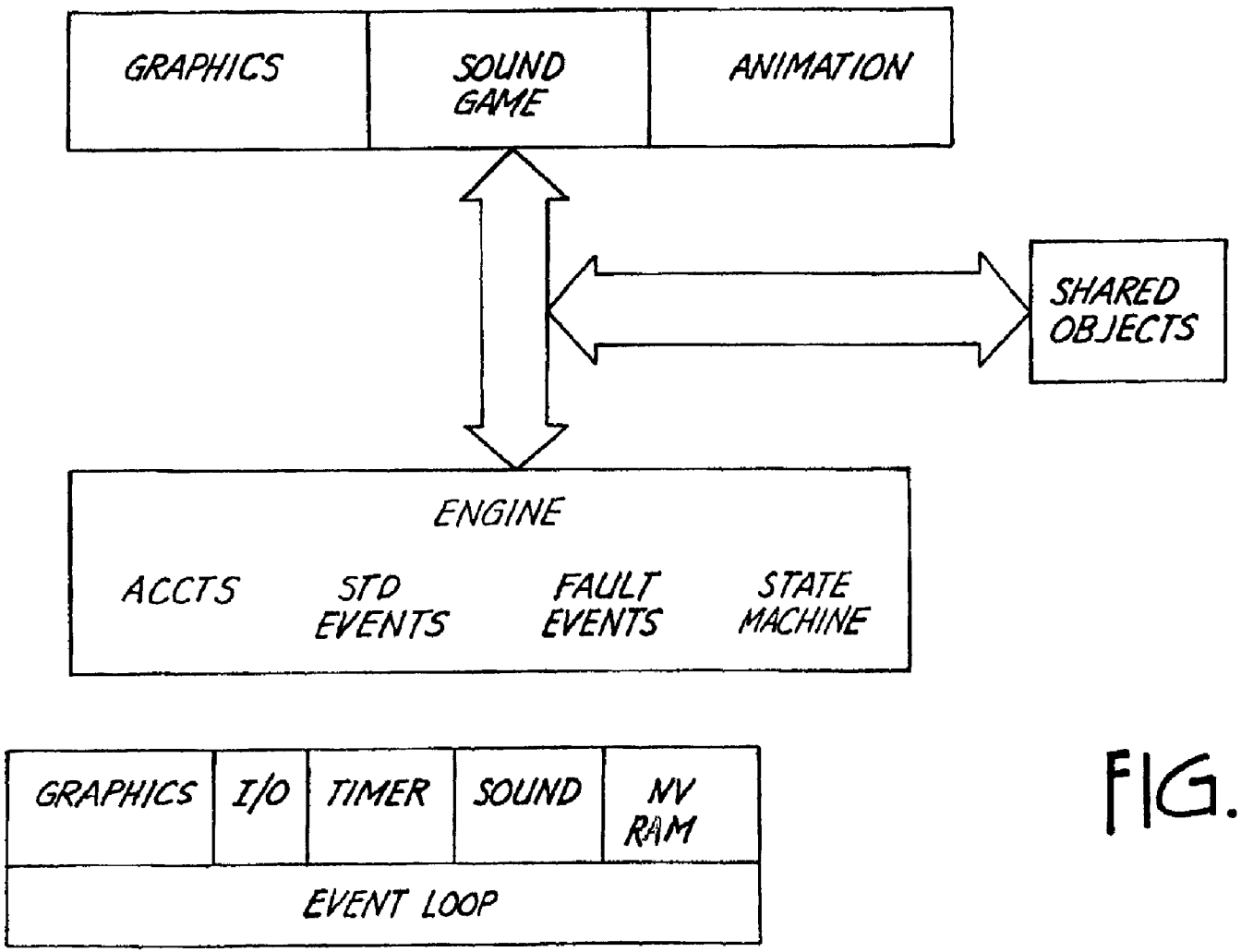
FIG. 3 is a schematic of the operating system and associated game software according to the present invention.

Preferred proprietary video wagering game software according to the present invention could consist of at least three main components: 1) an event loop; 2) an engine; and 3) game software as shown in FIG. 3. The shared objects are the features of the operating system that are used to compartmentalize the code and make the system more efficient. Existing hardware manufacturers for video wagering game apparatus must build each component and code for each component for each new game that is developed. In the practice of this invention it is possible to create a single event loop and engine code that can be used with each new game software, with components in the event loop and engine that may be superfluous for an individual game, but will provide support systems for any game components from among a variety of different games that can be asserted through or with the event loop and engine. The game software may vary in only graphics, sound an animation among certain classes of games, such as reel slot games.

The engine software might include apparatus specific software such as an accounting module, a standard events module, fault events module, state of machine module, and modules to monitor events that are specific to the apparatus itself. A fault event that might be identified would be where a panel or door has been opened or tampered with. A state of the machine function might be instructions to return the machine to the state that it was in at the time of a power loss, after the power has been recovered.

An event loop in many embodiments is constantly running. The event loop software waits for input from the peripherals, such as buttons, security device sensors, joysticks, or other input devices. Events are usually dealt with in the order that they are brought to the attention of the event loop, with the individual modules (e.g., graphics, I/O, timer, sound and non-volatile RAM) communicating with the event loop, but not necessarily with each other. The operating software may also be encrypted for protection, which is a significant concern within the gaming industry. A key may be necessitated to activate any de-encryption software. A separate device comprising hardware, software, or a combination thereof can also be provided to protect the software. One such hardware and software combination commonly used is referred to in the field as a 'dongle.' Unless the motherboard senses the presence of a dongle, the software requiring the presence of the dongle would then not function. Code could also be provided so that the software would self-corrupt or change if it sensed tampering. An alarm associated with such sensing would also be desirable, signaling a central control area or lighting up a warning light on the apparatus.

Figure 4:
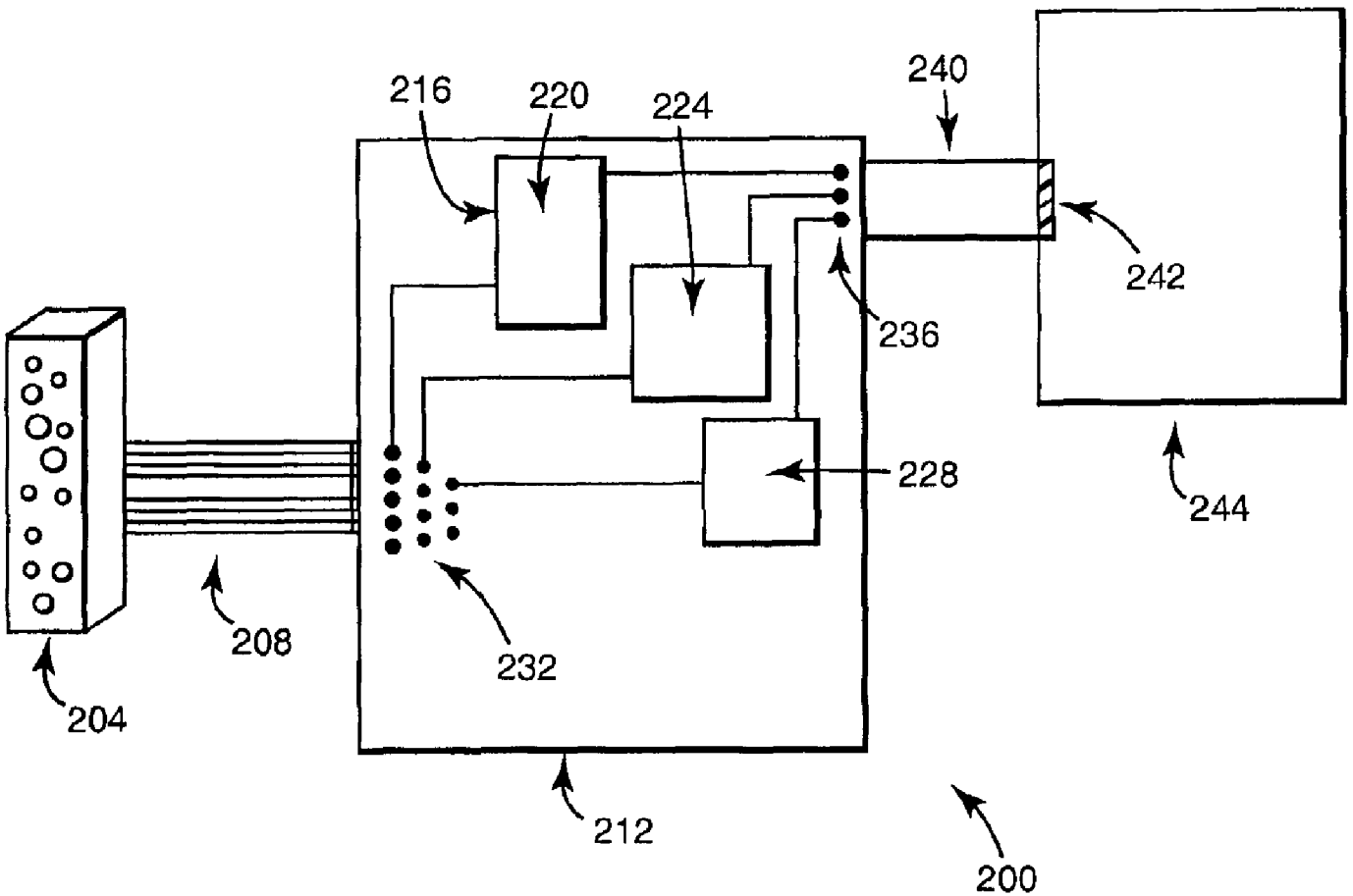
FIG. 4 illustrates one exemplary embodiment of a universal controller assembly according to the present invention.

FIG. 4 illustrates a universal controller assembly 200 according to the present invention. A pin connector 204 is connected through a multi-line conductor 208 to a circuit board 212. On the circuit board 212 are shown circuits 216. These circuits 216 may arbitrarily represent peripheral components for coin accepting 220, button controls 224 and currency validation 228. The circuits 216 are connected to output points 236 on the circuit board 212. A conductor 240 feeds from the output points 236 to a port 242 on a computer 244.

Definitions

In the practice of the present invention, the following definitions are used consistently within this patent. It is readily understood by those of ordinary skill in the art that, with the rapid changes in computer and chip technology, all values for information density, storage capacity, speed, rates of data transmission, number of ports, bit size, etc., are merely exemplary based upon commercially available equipment as of the time that this invention was described. Advances in the properties and formats of computers, chips, hardware and software are anticipated, and these improvements are expected to be used in the underlying practice of the present invention.

PC Means a Personal Computer

IO or I/O means Input/Output, such as an I/O device which is a device capable of receiving input and sending output.

Bus means groups of electrical signals or groups of electrical connections that carry the electrical signals which are referred to as a "bus." Thus, a reference to a "bus" can indicate a reference to a group of electrical signals, a group of electrical connections that carry the electrical signals, or a reference to both a group of electrical signals and a group of electrical connections that carry the electrical signals. Buses are typically made up of "bus lines." A reference to an individual "bus line" may refer to an electrical connection of a bus or an electrical signal of a bus.

Memory: The memory in computer systems is broken up into small sections called "bytes." Each byte in memory has a unique "address," similar to the unique addresses of personal residences. The information stored in memory is called "data." A computer system typically has three buses: an ADDRESS bus, a DATA bus, and a CONTROL bus. When a computer reads a piece of information from a particular address in memory, the CPU asserts the address of that particular point in memory onto the ADDRESS bus, then the CPU communicates to the memory chip to that the CPU desires to access the information stored in that address using the CONTROL bus. Then the memory chip asserts the information stored at that location onto the DATA bus. Finally, the CPU reads the data from the DATA bus. The above process is very fast, occurring at up to millions of times per second.

General Purpose Computer means a computer designed to have the capability and having the capability of executing a variety of software applications rather than a computer designed and optimized for a special purpose. An example of a special purpose computer would be a home game system such as a Nintendo system or Sega system that are designed and optimized for the sole purpose of executing video game software. A distinguishing feature of the general purpose computer is its capability to run non-video game software such as spread sheets, word processing, etc.

Progressive Meter Displays Preferably, a video imaging system such as a cathode ray tube, liquid crystal display, or tricolor LED system will be used for each of the overhead progressive meter displays which could be housed in interior casino sign. However, the system may include means to loop-back progressive data for in-machine progressive meters. The overhead displays are available with standard or high resolution pixel patterns. Overhead meters preferably display progressive jackpots with dynamic odometer effects, text messages and player attracting animation. In-machine progressive meters are available in enhanced resolution tricolor models and a single color, alpha-numeric model. This compact meter fits top award Insert areas on many popular games.

Machine Wiring Harness. Preferably, a set of discrete shielded cables or other field insulating system is used to connect certain peripheral device information data points inside the slot machine to any computerized game controller interface assembly. The in-machine harness preferably includes a soft tilt relay circuit that enables the computerized game controller assembly to "soft lockout" the game.

Soft Tilt Relay Circuit A soft tilt relay circuit is designed to enable the computerized game controller to place the slot machine in a soft tilt or lockout condition. While the slot machine is in this soft tilt condition, the customer will no longer be able to wager cash, coins, or credits; pull the handle; or activate the spin button. The customer will, however, be able to cash out any credits that are on the machine's credit meter. Alternatively, the soft tilt could be provided with the cooperation of the machine manufacturer in the form of an soft tilt EPROM that supports a lockout pin on an I/O port of the machine.

Logic Door A logic door may be installed by each gaming device manufacturer and is a door and key lock assembly that houses the gaming device's critical electronics (e.g., a motherboard, EPROMs, and any other programmable boards). A key lock assembly may be provided if it is not offered as an option by the manufacturer.

Logic Door Switch A switch may be attached to the logic door assembly that allows the gaming system's computerized controller to monitor any access to the slot machine's critical electronics.

Slot Machine Door Switch The computerized game controller may be able to monitor any opening or closure of a game system door either by interfacing with the existing manufacturer's switch or a separately attached switch, depending upon the machine type. The computerized game controller will disregard all coins received while the slot machine door is open and will report coins received while the door is open as an exceptioned event.

Power Supply The gaming system computerized controller usually requires a low voltage power supply unit to operate. This unit ordinarily will be located inside the slot machine and attached to the auxiliary power port of the machine's own power supply. Any interruption in power to the computerized game controller may be logged by the bank controller and reported as an exceptioned event.

Monitored Signals Preferably, the following gaming system information will be monitored continuously by the computerized game controller: coins in, coins to drop, coins out, jackpots, slot door access, logic door access, security enclosure access, tilt logic signal, blackout, slot machine reset, maintenance signals and status, bill validator signal and output signal.

Tilts The gaming system may indicate a tilt if any objectionable condition such as those listed in the Nevada Gaming Regulations Standards Section 1.070(2) occurs. On some manufacturers' games, such as the IGT S+ slot machine, the system will identify the specific tilt condition. These may include such events as a coin in tilt, coin out tilt, memory failure, hopper tilt, machine reset, reel tilt, slot door open, slot door close, jackpot, B switch (handle pull), and progressive jackpot.

Soft Tilt One optional feature of importance in the system is the soft tilt or soft lockout function. When a gaming system computerized controller can no longer verify important circumstances, such as a current jackpot amount, it will render the game unplayable yet still allow customers to cash out their credit balances. The soft lockout condition is most probably due to a prolonged loss of communications between either the slot machine microcontroller assembly and the bank controller, between the bank controller and the casino site master controller, or between the casino site master controller and the file server/polling computer.

The soft tilt relay circuit would be installed in the gaming system and allows the gaming system computerized controller to both initiate and implement the soft tilt operation. In some embodiments, the computerized controller is electrically isolated from the game by an interface assembly and cannot interfere with the normal mode or method of operation of the game.

During the soft tilt condition, the customer may cash out any credits remaining on the credit meter; however, after the completion of any game in progress, the customer will electronically be prevented from making any wager (cash, coin, or credit), or from starting a new game (handle pull or spin button). A light emitting digital indicator on a relay circuit can allow slot machine maintenance and floor personnel to quickly determine the current mode of the machine. Once the error condition that forced the gaming system into soft tilt mode has been corrected, the system will automatically restore the game to normal operation.

A relay circuit provides that the gaming system computerized controller be functioning properly for the game to be played. If power to the slot machine microcontroller assembly is interrupted, the relay circuit will render the slot machine unplayable Other Embodiments While there have been shown what are presently considered to be preferred embodiments of the invention, it will be apparent to those skilled in the art that various changes and modifications can be made herein without departing from the scope of the invention as defined by the appended claims.

In such computer systems, the components communicate via electrical signals; therefore, many components must be in electrical circuit communication to allow the signals to pass from component to component. These electrical signals are typically carried by electrical connections between the system components. Typical types of electrical connections include metal traces on a printed circuit board (PCB), via between different levels of multilayer PCBs, plated through holes, plugs, and individual wires connected from pin to pin of system components.

Preferably, a slot machine computerized game controller monitors all coins in, coins out, credits, currency exchanges, currency approval, jackpots, slot door access, logic door access, security enclosure access, slot machine reset, maintenance codes and tilt conditions (which include at least any of the tilt conditions listed in the Nevada State Gaming Regulations Standards 1.070(2)). The computerized game controller is also responsible for operating the soft tilt relay circuit. Furthermore, the computerized game controller can provide bill validator information, debit/credit and cashless capabilities. Every event monitored by the system should be precisely date and time stamped for reconciliation. The computerized game controller may also include a key pad interface for interfacing with a keypad. The interface would be programmed to include security access to game parameters, maintenance functions, and jackpot and bill transactions.

EXAMPLE 1

Development of PC104 to 4205 I/O Board

In the early stages of our engineering efforts we designed an adapter board useful for adapting older games to new electronics. We found that not all games operate the same with respect to how they use their inputs and outputs. For example, the specific type of input circuitry could be matrix, pull-up or grounded circuits. The earliest design of an adapter board had to have a conformation to take the harness that was already installed in the cabinet and make the connections with as few changes as possible to that harness. This information then could be used to design the adapter board. In one case, there was a board made by us for an adapter board for a printed circuit board where the edge connector had to be mounted upside down. Our research direction changed towards making an adapter for a PC-based system to a video gaming system based on the 4205 harness with the final goal of connecting a PC to a video wagering game machine by way of an adapter (I/O device). We found that initially what was needed was to design the following features:

The specifications of the 4205 harness had to be clearly identified. All lines from the 4205 harness had to be identified with respect to their designed and structured functions, that is, whether they are inputs, outputs, or power. Then, after designating the generic function for each of the outlets, it was then necessary for each of the different inputs to establish how many levels and what levels are present in those outlets. It was also necessary to determine, for each of the different outputs established, what levels are needed. It was then necessary to research the different type of controllers, integrated circuits that could be used for this type of circuit.

After this preliminary novel investigation was performed, it was necessary to:

1) Design and refine the schematic for the circuit.
2) Then design dimensions, layout, and placement of parts for a printed circuit board.
3) Prototype and troubleshoot the layout and the circuit.
4) Documentation and BOM for the new board The PC/104 is at present the preferred system for the I/O formatting. PC/104 gets its name from the popular desktop personal computers initially designed by IBM called the PC, and from the number of pins used to connect the cards together (104). PC/104 cards are much smaller than ISA-bus cards found in PC's and stack together, eliminating the need for a motherboard, backplane, and/or card cage. Power requirements and signal drive are reduced to meet the needs of an embedded system. Because PC/104 is essentially a PC with a different form factor, most of the program development tools used for PC's can be used for a PC/104 system. This reduces the cost of purchasing new tools and also greatly reduces the learning curve for programmers and hardware designers.

The PC/104 form factor was developed by Ampro Computers in California in the late 1980's. The specification was published in 1992 in order to enhance popularity. Now over 150 vendors manufacture PC/104 compatible products including controller cards, software, and accessories.

While the PC and PC/AT architectures have become extremely popular in both general purpose (desktop) and dedicated (non-desktop) applications, its use in embedded microcomputer applications has been limited due to the large size of standard PC and PC/AT motherboards and expansion cards.

The PC/104 standard specification supplies the mechanical and electrical specifications for a compact version of the EEE P996(PC and PC/AT) bus, optimized for the unique requirements of embedded systems applications. The specification is herein referred to as "PC/104", based on the 104 form factor, signal interconnects, and other specifications.

Many embedded systems must control large devices such as motors, lights, displays, record functions, etc. Driving such a load is normally done by attaching a digital output signal to a relay. The relay controls the large load from the small digital system in the same way that your car key switch controls your starter through a solenoid. There are both mechanical and solid-state relays on the market. Traditional mechanical relays rely on a coil that creates a magnetic field to cause the contacts to close or open. These coils normally require even more current than an digital output signal can provide requiring a buffer circuit in the form of a transistor. Mechanical relays can obviously wear out due to the moving parts involved. Contacts in the relay often arc creating a carbon deposit and electrical noise that can disturb near-by electrical equipment like the control computer. A computerized controller such as a PC/104 computer can thereby control a variety of high-current lights, motors, and other devices via low-current logic signals as are commonly associated with computer logic control systems.

Solid State Relays

Solid state relays provide the same function as their mechanical counterpart but without many of the disadvantages. Since there are no moving parts, the need for contact cleaning is eliminated. Contact bounce and electrical noise are also non-existent in solid state models. Virtually all solid state relays also provide optical isolation which eliminates the direct electrical connection between the control computer and the load being switched. This goes a long way to protect sensitive digital computers and eliminate load noise from feeding back to the computer. Solid state relays also don't require as much current as mechanical models and can usually be driven directly from a digital output pin.

Digital I/O Boards

Many digital I/O boards are available for PC/104 systems. Some will provide dozens of I/O pins to control devices and read digital sensors, switches, etc. Multi-function boards are also available that provide digital I/O plus analog inputs, timers, counters, and other useful functions.

Electrical Spikes

When large loads are switched ON or OFF, electrical noise and voltage spikes can be created. If these effects make their way back to the control computer, it could stop the program, or worse, destroy circuits. Several devices exist to dampen spikes including MOVs (Metal Oxide Varistors), and Transzorbs. Most solid state relays already contain a protection device.

Cable and Connectors

It is desirable to calculate the current needed for the service load on the apparatus and then to size the cables and wires accordingly. Undersized wires can melt under heavy loads and cause fires. Connectors must also be capable of carrying the load.

Grounding

It's normally safer to connect the frame of a machine having power loads to earth ground. Doing so, prevents an electrical short from creating an electrical shock condition for operators.

Many single board computer manufacturers provide additional software/firmware support for a variety of operating systems that are specific to their hardware. Another very simple way to implement a nonvolatile storage device for these types of applications is to use an IDE interface Flash Disk device. These are available from many of the single board computer manufacturers as well as third parties. These devices greatly simplify system development by using an IDE port on the single board computer. Thus, the user would follow the same steps as would be used in preparing any IDE hard drive for the operating system that is chosen, and further complies with regulations that may require gaming system code to be stored in nonvolatile memory.

Figure 5:
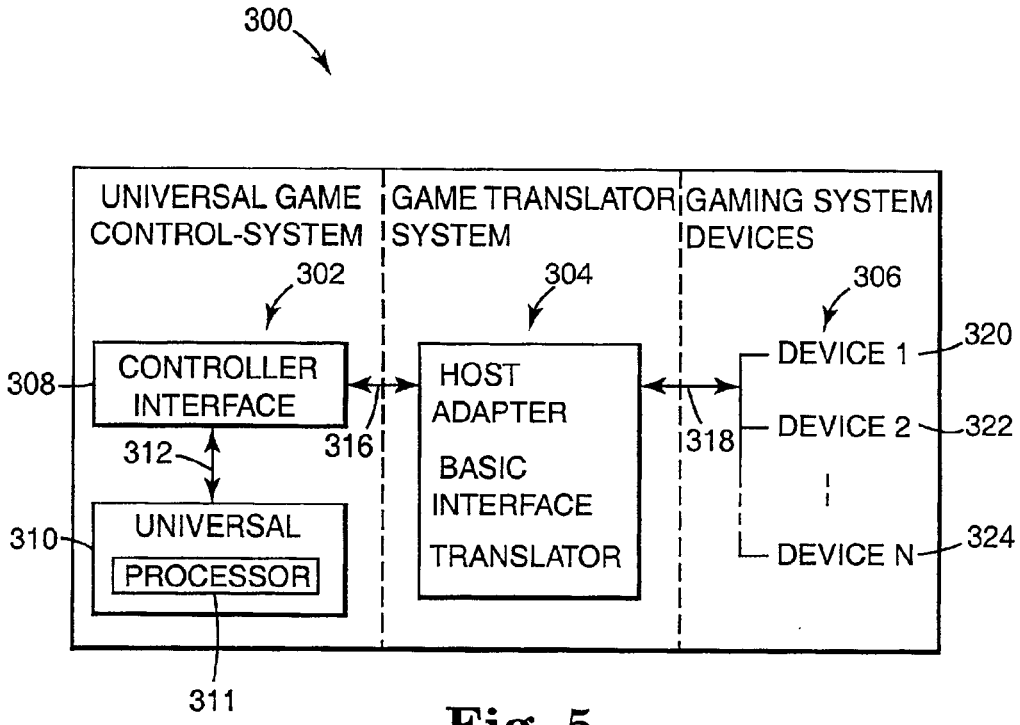
FIG. 5 is a block diagram illustrating another exemplary embodiment of a gaming system according to the present invention.

FIG. 5 is a block diagram generally illustrating another exemplary embodiment of a gaming system according to the present invention generally at 300. Gaming system 300 includes a universal game platform or control system 302 and a game translator system 304. In one embodiment, the game translator 304 is termed a Host Adapter Basic Interface Translator (HABIT) System. The game translator system 304 operates as a "translator" interface between the universal game control system 302 and gaming system devices 306. In one exemplary embodiment, universal game control system 302 includes the controller interface 308 and a universal controller 310. In one embodiment, the controller interface 308 is termed a Habit Interface to CHIMP (HIC) System. In one embodiment, the universal controller 310 is termed a Compact Highly Integrated Multipurpose Plateform (CHIMP) System. The controller interface 308 is in communication with controller 310 via communications bus 312. At controller interface 308, the universal game control system 302 communicates with game translator system 304 via communications bus 316. Game translator 304 communicates with gaming system devices 306 via communications bus 318.

Universal controller 310 includes a processor or central processing unit (CPU) 311. In one preferred embodiment, the controller 310 is an embedded computer system (embedded PC). Universal controller 310 operates to process game operation system commands, and may directly interface with certain gaming system devices 306, or indirectly interface with gaming system devices 306 via controller interface 308 and game translator system 304.

Controller interface 308 operates as a communications bus interface between game translator 304 and universal controller 310. Universal controller 310 communicates with controller interface 308 via communications bus 312.

In one embodiment, processor 311 communicates with an I/O card in control interface 308 via a standard communications bus. In one preferred embodiment, the standard communications protocol is a PC/104 protocol, as previously described herein.

Universal game control system 302 is configured to operate and process gaming system instructions for a variety of types of gaming systems (e.g., video gaming system, slot machine, etc). Universal game control system 302 communicates with specific gaming system devices 306 via game translator system 304. Game translator system 304 is unique to the devices utilized for each specific game. In particular, game translator system 304 includes a plurality of device drivers and receivers for allowing the gaming system devices 306, illustrated as DEVICE 1 320 DEVICE 2 322 through DEVICE N 324, to communicate with universal game control system 302.

The communications link between controller interface 308 and game translator system 304 is a communication link unique to the configuration of game translator system 304. In one aspect, the communication link is a bi-directional data bus with control signals. In another aspect, the communication link is the Universal Serial Bus (USB) port. Game translator system 304 is uniquely configured to communicate with the devices which are specific to each type of gaming system, such as coin acceptors, hopper, bill acceptors, printer, etc.

Exemplary embodiments of the computerized gaming system 300 having universal game control system 302, game translator 304 and gaming system devices 306 are described in detail in reference to FIGS. 6–10 in the following paragraphs.

Figure 6:
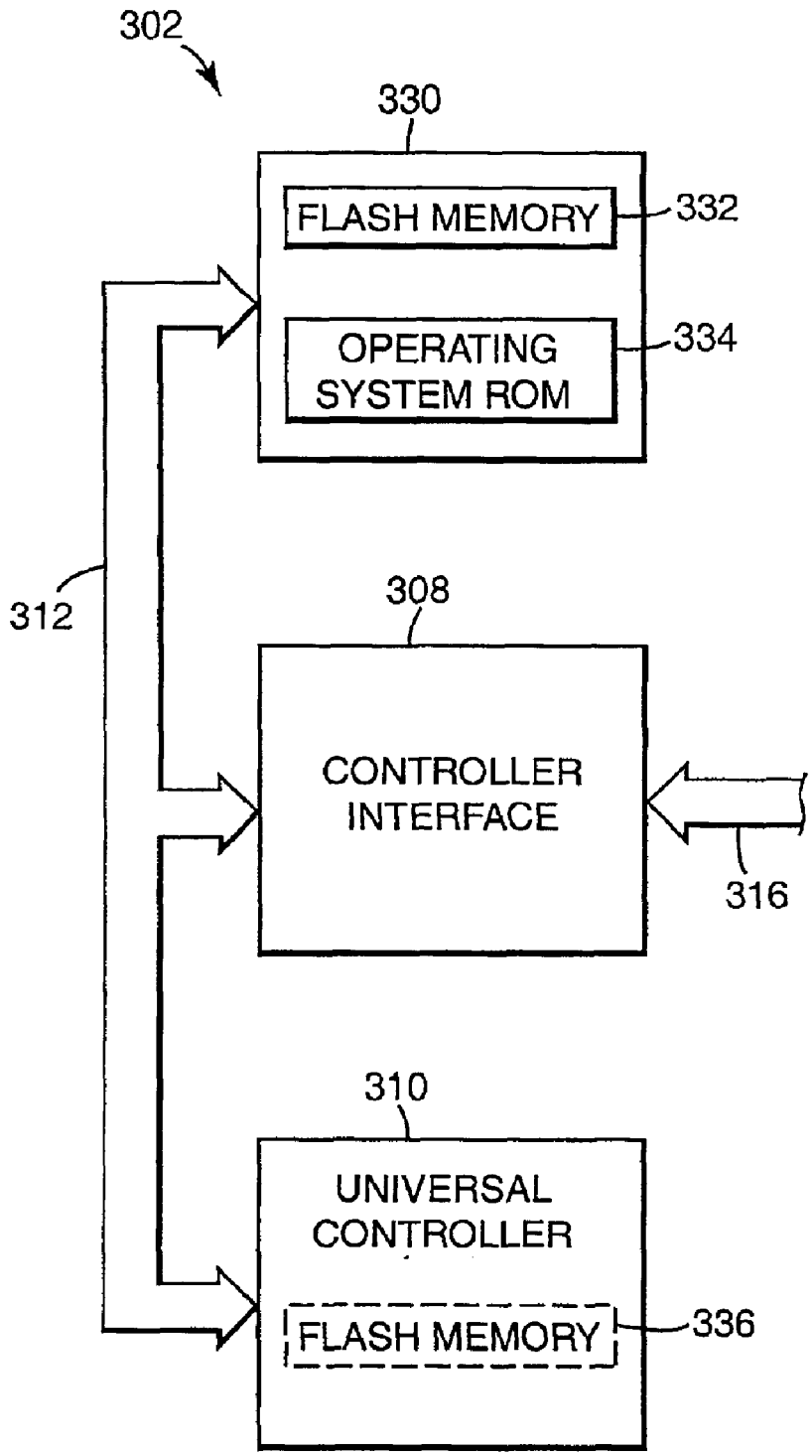
FIG. 6 is a block diagram illustrating one exemplary embodiment of the universal game platform shown in FIG. 5.

FIG. 6 is a diagram illustrating on exemplary embodiment of a universal game control system 302 according to the present invention. The universal game control system 302 has a universal platform or format which is configured to operate with a variety of types of gaming systems, without changing the system 302. Universal game control system 302 includes an operating system controller 330, controller interface 308 and universal controller 310. Game operating system controller 330, controller interface 308 and universal controller 310 communicate via communications bus 312 using a standard bus protocol. In one embodiment, communications bus 312 is a PC/104 bus.

In one aspect, game operating system 330 includes flash memory 332 (e.g., Disk On Chip®, Compact Flash®) and read only memory (ROM) 334. In one aspect, the "game layer" or game program (e.g., game data set) is stored in flash memory 332 which is unique to the game played on gaming system 300. Suitable flash memory is commercially available from Kingston Technology Company in Fountain Valley, Calif., USA (e.g., CF/8 8 megabyte or CF/32 32 megabyte). The game operating system is stored in ROM 334. In one aspect, the game operating system 330 is a solid state disk module. One solid state disk module suitable for use with the present invention is a PCM-3810 solid state disk module commercially available from Advantech Co. The gaming system 300 game layer or game data set is stored in flash memory 332, which in one preferred embodiment is Disk On Chip® flash disk. The operating system is stored on ROM 334 which in one aspect is a set of common erasable programmable read only memorys (EPROMs). One exemplary embodiment of a game operating system including a game layer using flash memory is disclosed in PCT Patent Application No. PCT/USO1/07447 filed Mar. 8, 2001, entitled "Computerized Gaming System, Method and Apparatus," which is incorporated herein by reference.

In another aspect, the flash memory 332, where the game personality or game layer is stored, is located on the universal controller 310, indicated in dashed lines at 336. In one aspect, the flash memory 336 located on universal controller 310 is a Compact Flash® having a removable compact flash memory card. In one aspect, the game operating system 330, controller interface 308 and universal controller 310 are located on separate printed circuit boards, which in one embodiment are stacked printer circuit boards, and communicate via communications bus 312. In another embodiment, the game operating system 330, controller interface 308 and universal controller 310 are located on a common printed circuit board.

Figure 7:
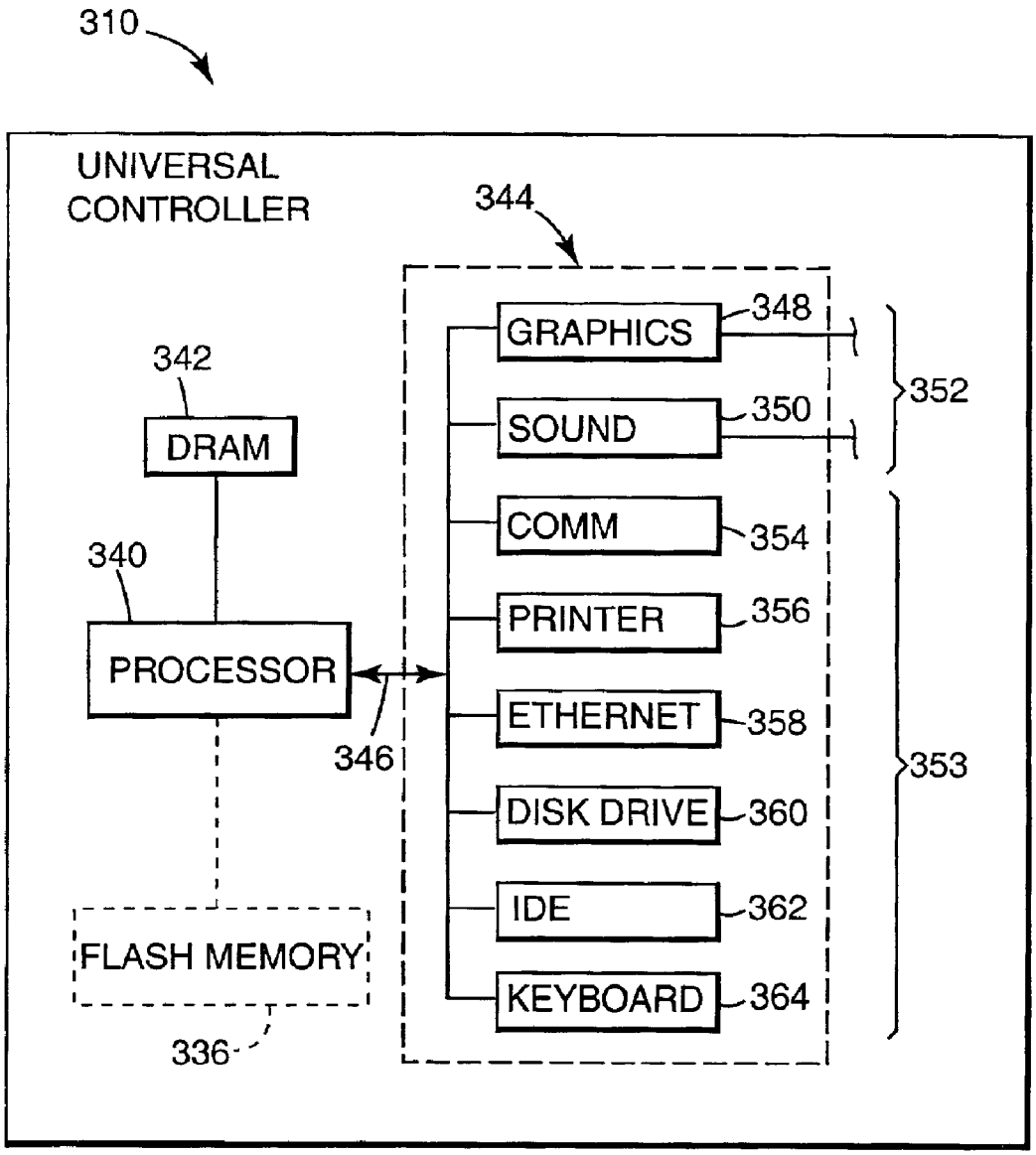
FIG. 7 is a block diagram illustrating one exemplary embodiment of a controller used in a gaming system according to the present invention.

FIG. 7 is a block diagram illustrating one exemplary embodiment of a universal controller 310 used in a gaming system 300 according to the present invention. The universal controller 310 is configured to be universally useable for to many different types of gaming systems. In operation, the universal controller 310 operates to process game operating system instructions and game program instructions, and is responsive to game events received from gaming system devices 306. The universal controller 310 indirectly communicates with gaming system devices 306 via controller interface 308 and translator system 304. The universal controller 310 communicates directly with other gaming devices via drivers or interface cards 344.

In one embodiment, universal controller 310 includes processor or CPU 340, random access memory 342 (e.g., a dynamic random access memory (DRAM)), and interface cards 344. Processor 340 utilizes DRAM 342 for storing and queuing gaming system program and operating instructions. Processor 340 communicates with interface cards 344 via communications bus 346. In one exemplary embodiment illustrated, interface cards 344 includes a graphics card 348, a sound card 350, a communications card 354, a printer card 356, an Internet card 358, a disk drive card 360, an intelligent or integrated drive electronics (IDE) interface card 362 and a keyboard interface card 364. Graphics card 348 and sound card 350 are directly connected or linked to devices located on the gaming system 300. Similarly, other devices 353 may be directly linked to devices either local to universal controller 310, such as disk drive 360, or a user interface gaming system device such as a printer being connected to printer interface card 356. Other suitable interface cards or device drivers will become apparent to one skilled in the art after reading the present application.

Figure 8:
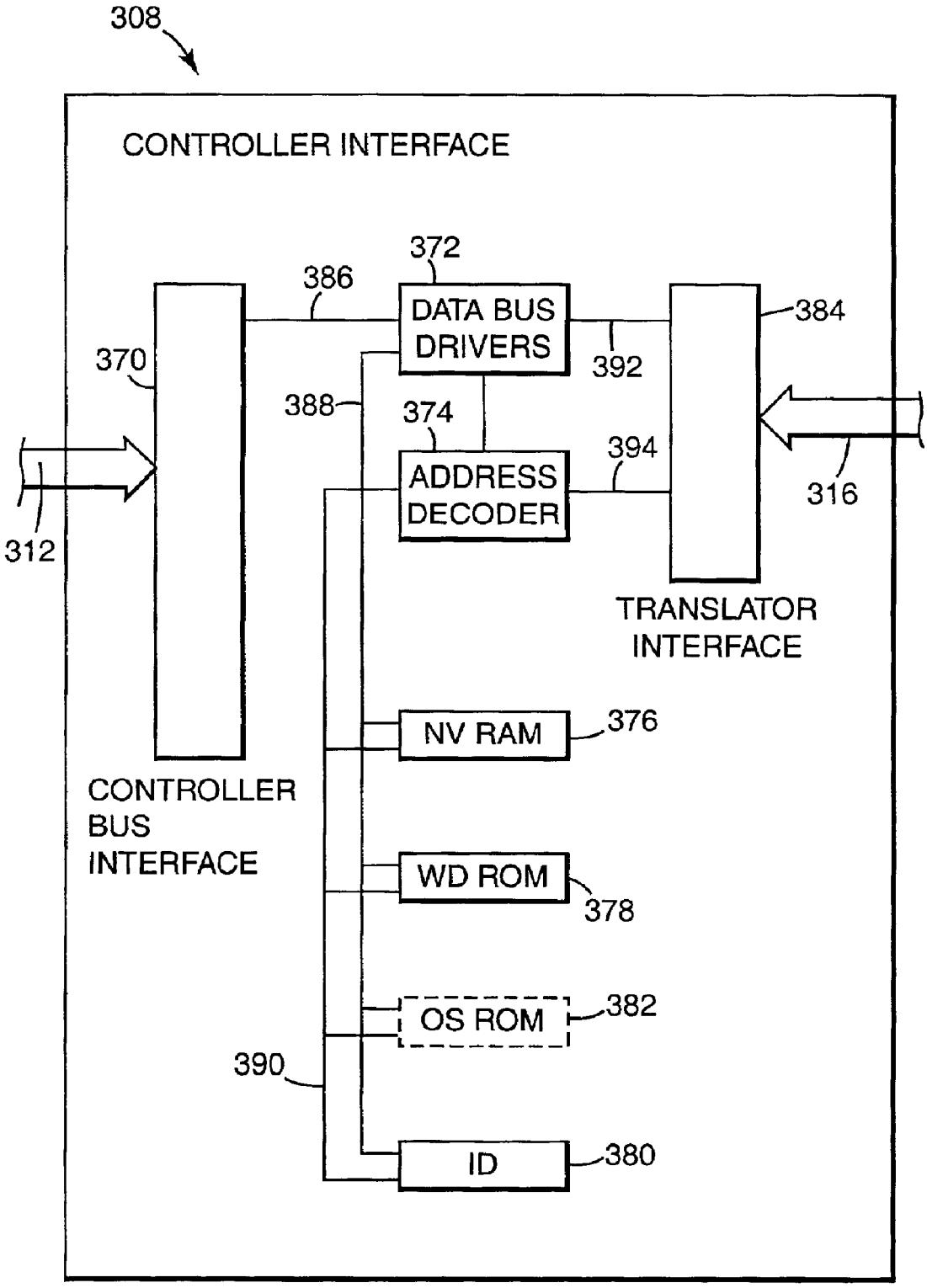
FIG. 8 is a block diagram illustrating one exemplary embodiment of a controller interface used in a gaming system according to the present invention.

FIG. 8 is a block diagram illustrating one exemplary embodiment of a controller interface used in a gaming system according to the present invention. Controller interface 308 operates as an interface between universal controller 310 and game translator 304. The unique controller interface 308 together with the universal controller 310 are useable in many different gaming devices. As such, in order to change a gaming system to a different type of game or convert a gaming system to a different type of game, only the translator system 304 needs to be uniquely configured for the specific game. As such, the controller interface 308 allows the same universal gaming system to be used in both new and existing video and mechanical (e.g., a mechanical reel slot machine) based gaming systems. This allows for standardized maintenance/game verification for all gaming systems. Proprietary systems are no longer necessary. Controller interface 308 includes controller bus interface 370, data bus drivers 372, address decoder 374, non-volatile random access memory (NV RAM) 376 "read only memory" ROM (WD ROM) 378, ID tag 380, and translator interface 384. Controller interface 308 communicates with the other universal game control system 302 devices via communications bus 312 at controller bus interface 370. In one aspect, the controller bus interface 370 is configured to communicate with a PC104 bus. Controller bus interface 370 is in communication with data bus drivers 372 via communications bus 386. Data bus drivers 372 are in communication with NV RAM 376, WD ROM 378 and ID tag 380 via data bus 388. Address decoder 374 is in communication with NV RAM 376, WD ROM 378 and ID tag 380 via address bus 390. Data bus drivers 372 are connected to translator interface 384 via communications bus 392. Address decoder 374 is connected to translator interface 384 via communications bus 394. Translator interface 384 operates as an interface between the controller interface 308 and communications bus 316.

Data bus drivers 372 allow the controller interface 308 and universal controller 310 processor 311 to communicate with game translator system 304 and corresponding gaming system devices 306. Address decoder 374 allows the controller interface 308 to communicate with game translator system 304. NV RAM 376 is utilized for storing critical gaming system data, such as game pay out results, current game state, set up parameters, etc. Address decoder 374 decodes addresses, for example, when addresses in non-volatile RAM 376 are being accessed by processor 340 or translator 304. Similarly, address decoder 374 decodes addresses for accessing WD ROM 378. WD ROM 378 includes a code which performs "watchdog" functions on game programs or data sets run or gaming system 300. In particular, during operation if gaming system 300 the game data set is continuously verified by running the "watchdog" program stored in ROM 378 to determine or confirm that no change has occurred in the game data set.

One suitable verification process for use with the present invention is disclosed in U.S. patent application Ser. No. 09/520,404, filed Mar. 8, 2000 entitled "Encryption in a Secure Computerized Gaming System" which is incorporated herein by reference. Another suitable verification process for use with the present invention is disclosed in PCT Patent Application No. PCT/USO1/07381 filed Mar. 8, 2001, entitled "Encryption in a Secure Computerized Gaming System," which is incorporated herein by reference.

Alternatively, ROM 382 may be located on controller interface 308. ROM 382 may be utilized for storing the operating system previously illustrated as located on game layer 330.

Controller interface 308 may further include ID or ID tag 380. In one embodiment, ID 380 is a Silicon Serial Number (SSN). ID 380 has an identification number or code which is unique to gaming system 300. As such, ID 380 functions to uniquely identify the controller interface assembly 308, and that data stored in the NV RAM 376. In one exemplary embodiment, the ID 380 is used as an encryption key for communications with external data gathering and control systems.

Figure 9:
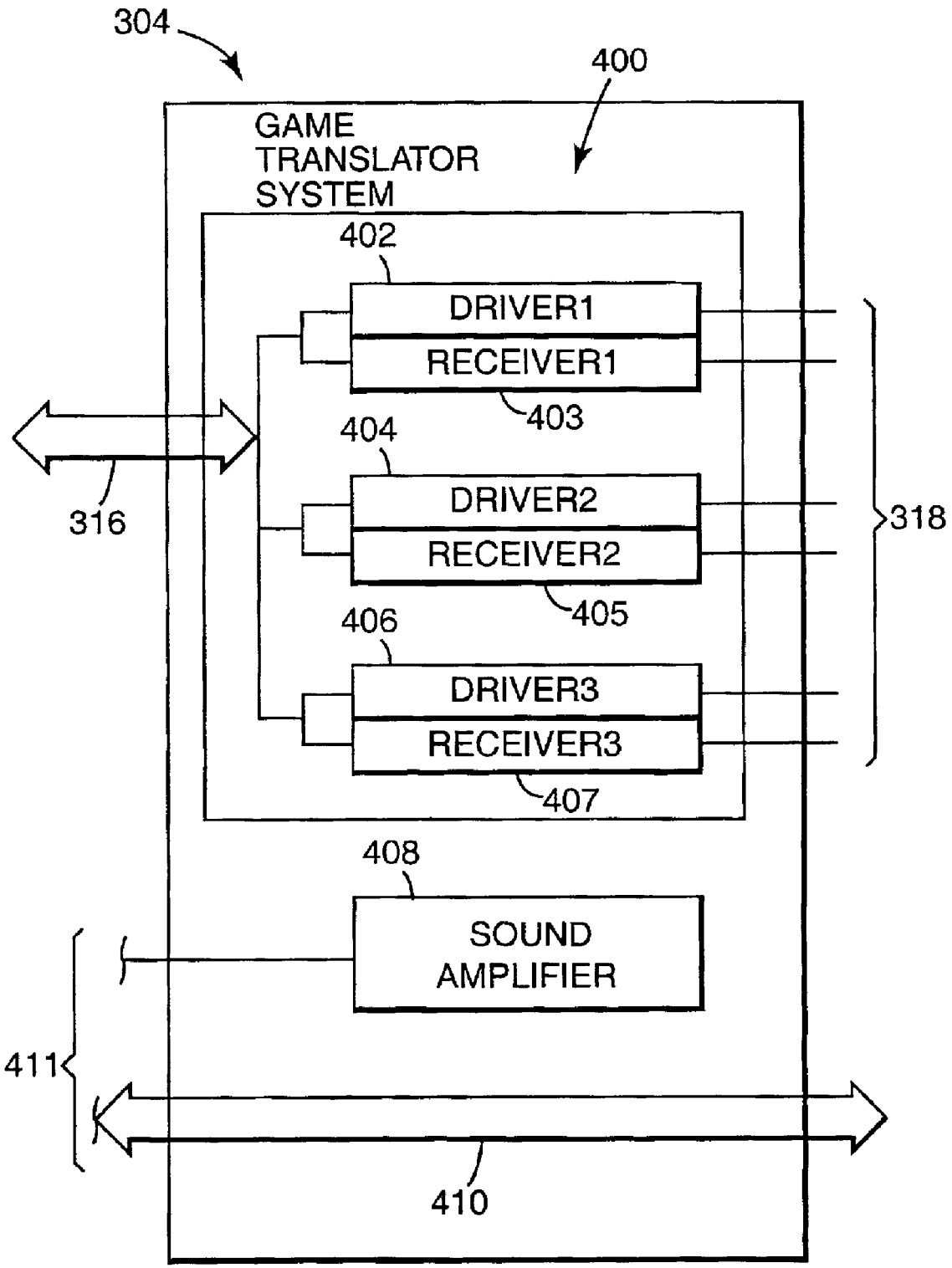
FIG. 9 is a block diagram illustrating one exemplary embodiment of a translator system used in a gaming system according to the present invention.

FIG. 9 is a diagram illustrating one exemplary embodiment of game translator system 304 used in a gaming system according to the present invention. Game translator system 304 is uniquely configured for each specific gaming system. As such, game translator system 304 operates to "translate" signals between the universal game control system 330 and specific gaming system devices 306. As such, the game translator system for a video gaming machine may be the same as the game translator system for a different video gaming machine, but is different for a gaming machine having different gaming system devices such as a mechanical reel-based slot machine.

Game translator system 304 includes various devices for converting signals to levels usable by the gaming system devices 306, or in turn usable by universal game control system 302. In one exemplary embodiment, game translator system 304 includes drivers and receivers for interfacing communications bus 316 with each specific gaming device 306. A separate driver and/or receiver is utilized for each device. For example, DRIVER 1 402 and RECEIVER 1 403 are configured specifically for a first gaming system device, DRIVER 2 404 and RECEIVER 2 405 are configured specifically for a second gaming system device, and DRIVER 3 406 and RECEIVER 3 407 are configured specifically for a third gaming system device. The drivers and receivers may be configured to translate between digital and analog signals, between signals having different voltage levels, and/or other different types of signals, etc.

Game translator system 304 also includes other "translation" devices, which may interface directly with universal controller 310. In one exemplary embodiment, game translator system 304 includes a sound amplifier 408 which is directly coupled to a sound interface card 350 at universal controller 310 and a speaker gaming system device for outputting sound (e.g., bells, whistles, music, verbal instructions, etc.). Further, game translator system 304 may also simply act as a pass through device or wireway for between universal controller 310 and the gaming system devices, such as the on-line system, bill acceptor, printer, touch screen, or other devices which may directly interface with interface cards located at universal controller 310.

Figure 10:
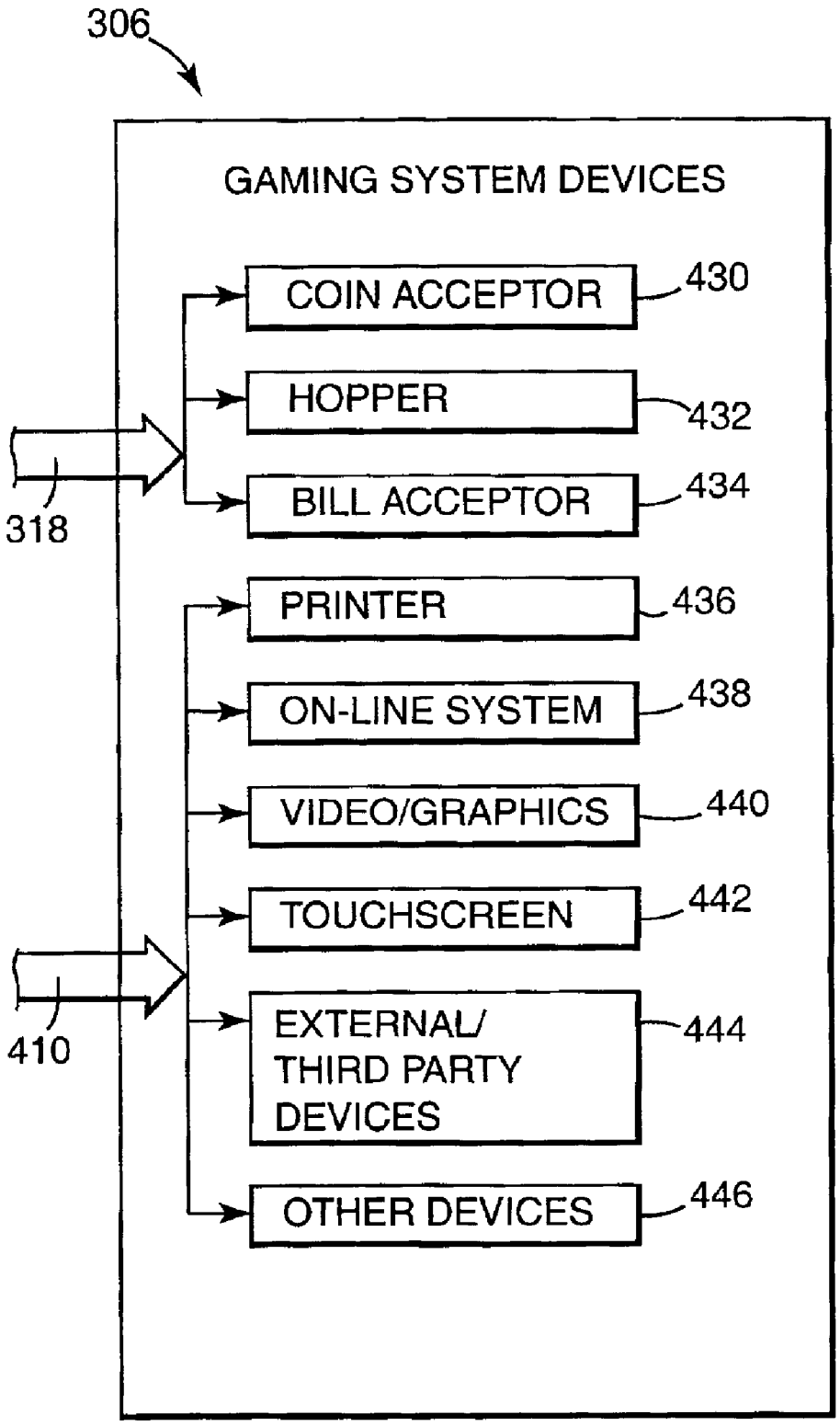
FIG. 10 is a block diagram illustrating one exemplary embodiment of gaming system devices used in a gaming system according to the present invention.

FIG. 10 is a diagram illustrating one exemplary embodiment of gaming system devices 306 used in a gaming system 300. The gaming system devices illustrated may be typical of a video gaming system (e.g., Press Your Luck™ Video). In one exemplary embodiment, the gaming system devices include a coin acceptor 430, hopper 432 and bill acceptor 434. Each of these devices interfaces with the universal game control system 302 via game translator system 304 using communication bus 318. The gaming system devices 306 include other devices which may interface directly with universal controller 310, and as such, may simply pass through translator 304 via wireway 410. These gaming system devices may include a printer 436, an on-line system 438, video/graphics 440, touch screen 442, external/third party devices 444, or other devices 446. For example, printer 436 interfaces directly with printer interface card 356. On-line system 438 interfaces directly with Internet interface card 358. Video/graphics system device 440 interfaces directly with graphics interface card 348. Touch screen system device 442 interfaces directly with communication interface card 354 or keyboard interface card 364. External/third party device 444 may interface directly with IDE interface card 362.

Figure 11:
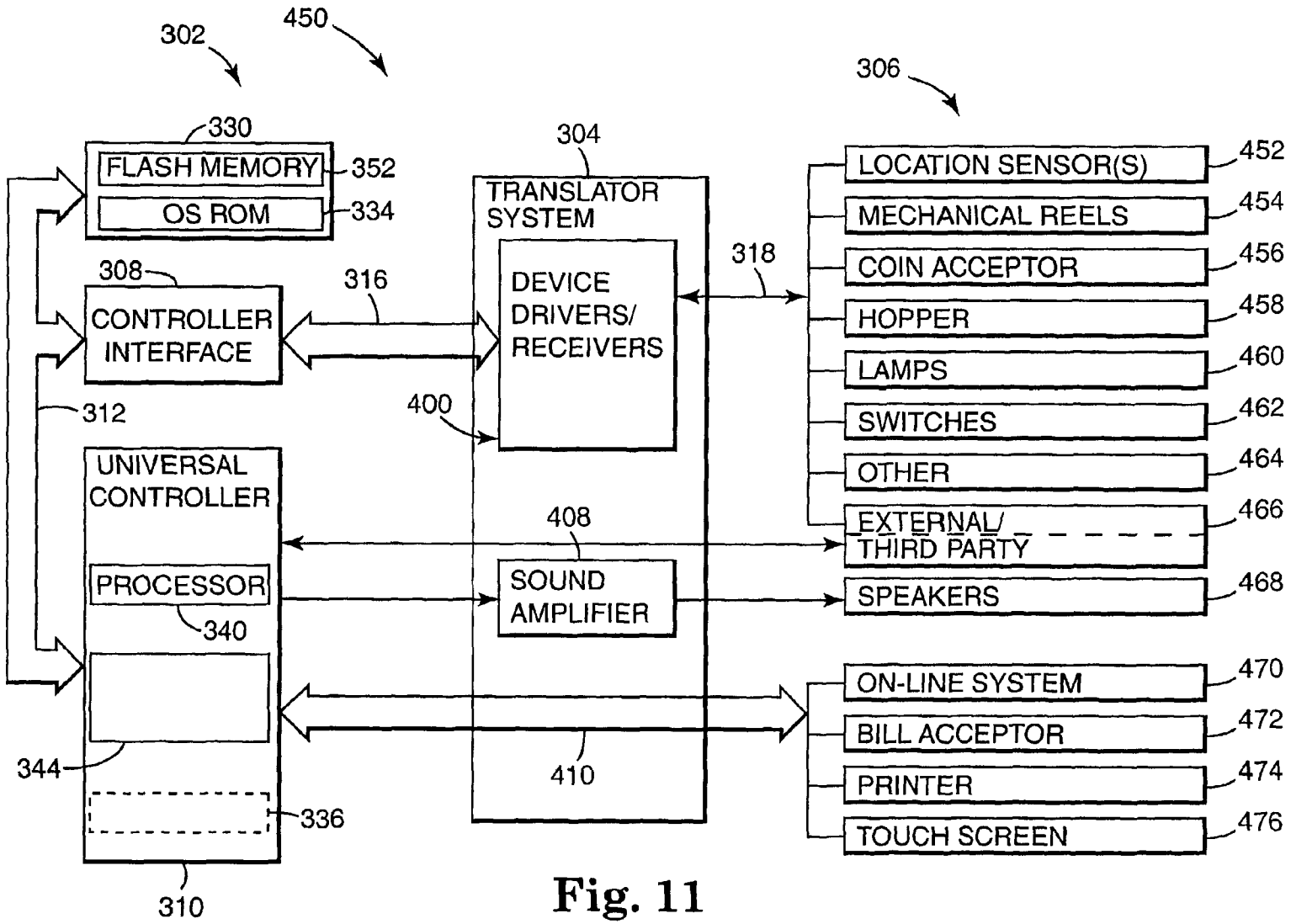
FIG. 11 is a block diagram illustrating one exemplary embodiment of a gaming system according to the present invention used in a slot machine.

FIG. 11 is a diagram illustrating one exemplary embodiment of a gaming system 450 according to the present invention. The gaming system 450 can be similar to the gaming system 300 previously described herein. The gaming system 450 is configured for operation as a mechanical reel-based slot machine (e.g., IGT S+). In the diagram illustrated, the gaming system 450 is utilized in converting an existing mechanical reel based slot machine into a slot machine which utilizes a universal game control system according to the present invention. In particular, the slot machine includes the following gaming system/user interface devices: location sensors 452 for the slot machine mechanical reels, mechanical reels 454, coin acceptor 456, hopper 458, lamps 460, switches 462, other devices 464, external/third party devices 466, speakers 468, on-line system 470, bill acceptor 472, printer 474, and touch screen 476. Each of these existing devices 306 have specific electrical/mechanical characteristics which need to be interfaced with universal game control system 302. The gaming system devices 306 are disconnected from the existing, proprietary game control system. The existing game control system is physically removed from the game cabinet. The gaming system 450 is inserted into the cabinet, including connecting the universal game control system 302 and game translator system 304 with the unique, existing game system devices 306. In particular, universal game control system 302 includes operating system controller 330, controller interface 308, and universal controller 310, all connected via communications bus 312. Translator system 304 includes device drivers and receivers 400 for translating the signals, voltage levels, etc. unique to gaming devices 306 to levels usable by logic communication bus 316. In one embodiment, logic communication bus 316 communicates signals between controller interface 308 and translator system 304 having either a logic high (e.g., 5 volt DC) or a logic low (e.g., 0 volts DC).

In one exemplary embodiment, the mechanical reels location sensors 452 operate at a voltage level between 5 and 12 volts DC. Translator system 304 includes a pair of device drivers/receivers for converting the sensed DC signal to a corresponding logic high or logic low signal output on logic communications bus 316. Mechanical reels 454 operate at 24 volts DC. Translator system 304 includes a pair of mechanical reels device driver/receivers for converting a logic high or low DC signal via logic communication bus 316 to a corresponding DC voltage signal usable by mechanical reels 454. In a similar manner, translator system 304 includes a pair of device drivers/receivers for translating between a logic signal on logic bus 316 and a 12 volt DC signal on coin acceptor 456; between a logic signal on logic communications bus 316 and a 12–24 volt DC or a 110 volt AC hopper 458; a logic signal on logic bus 316 and 5–12 volt AC or DC lamps; a logic signal on logic bus 316 and ground switches 462; and a logic signal on logic communications bus 316 and other devices 464 or external/third party devices 466.

Translator system 304 also includes a sound amplifier 408 which is directly connected to the sound interface card at universal controller 310. The sound card provides an output signal to sound amplifier 408, which is amplified at sound amplifier 408 and output to speakers 468. The on-line system (e.g., casino house controls, camera system, etc.) 470, bill acceptor 472, printer 474 and touch screen 476 are all directly connected to interface with universal controller 310 (e.g., via interface cards 344). In the exemplary embodiment illustrated in converting an existing mechanical reel based slot machine to a slot machine having a universal game control system the on-line system 470, bill acceptor 472, printer 474 and touch screen 476 are coupled to wire connectors set up in translator system 304, which acts as a direct wire way to the universal controller 310. External/third party devices 466 may also be directly connected (e.g., via translator system 304) to other interface cards located at universal controller 310.

For example, the external/third party devices may be top boxes for bonusing schemes, progressive jackpot systems, signs, etc. Suitable external/third-party devices for use with the present invention will be apparent to one skilled in the art after reading the present application. The gaming system 450 according to the present invention allows a mechanical reel based slot machine to be converted to a gaming system having a universal game control system. A unique translator system 304 is configured for interfacing between the specific gaming system devices 306 and the universal game control system 302. As such, the universal game control system is usable for both video based gaming systems and mechanical based gaming systems. Only the translator system 304 need be changed to be specifically adapted for each type of gaming system.

Figure 12:
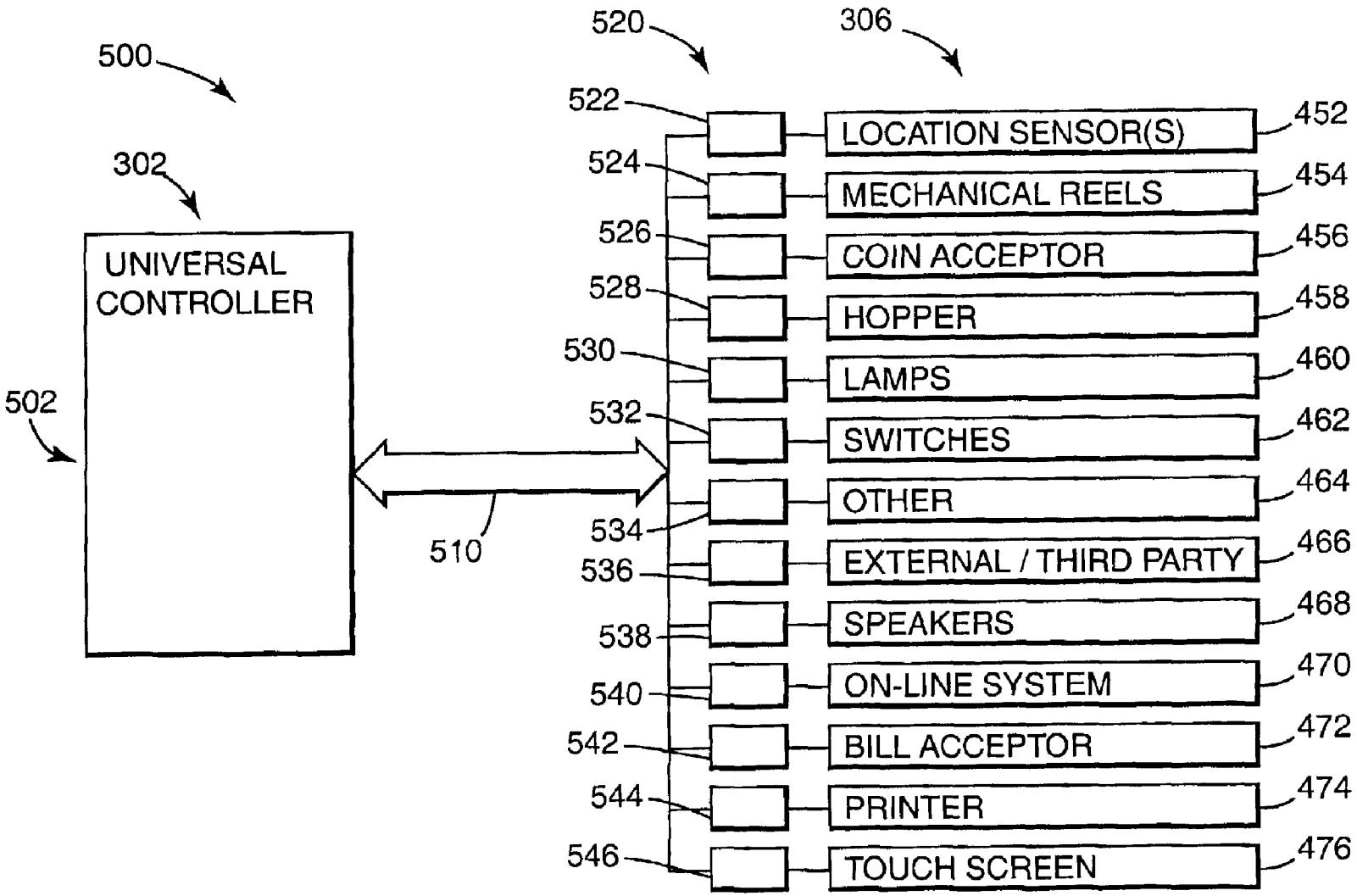
FIG. 12 is a block diagram illustrating another exemplary embodiment of a gaming system according to the present invention.

FIG. 12 is a block diagram illustrating another exemplary embodiment of a gaming system according to the present invention generally at 500. The gaming system 500 includes universal controller 502 which communicates with gaming system devices 306 via I/O modules 520 which are unique to each device. In particular, universal controller 502 communicates with gaming system devices 306 via a single communication link 510, which in one preferred embodiment is a universal serial bus. This results in a single cable between the universal controller 502 and the gaming system devices 306, as opposed to a plurality of wires and cables. An I/O module 520 is located at each device, and having a configuration which is unique to each device. For example, the I/O device 520 may comprise a driver and receiver, or alternatively may comprise a voltage regulator, etc., such that it acts as a translator between the universal controller 502 and the gaming devices 306. In the exemplary embodiment illustrated, module 522 is located adjacent location sensors 452; module 524 is located adjacent mechanical reels 454; module 526 is located adjacent coin acceptor 456; module 528 is located adjacent hopper 458; module 530 is located adjacent lamps 460; module 532 is located adjacent switches 462; module 534 is located adjacent other devices 464; module 536 is located adjacent externals/third party device 466; module 538 is located adjacent speakers 468; module 540 is located adjacent on-line system link 470; module 542 is located adjacent to bill acceptor 472; module 544 is located adjacent to printer 474; and module 546 is located adjacent touch screen 476. All of the modules 520 are connected to a common cable represented by communication bus 510. Everything is controlled from a central unit at universal controller 502.

The above described configuration shown in FIG. 12 allows for adaptability and maintenance for various gaming systems. For example, if the touch screen 476 is changed out from gaming system 500, the replacement touch screen may have different signal requirements than the previous touch screen. In order to adapt the universal controller 302 to be able to communicate with the replacement touch screen, only module 546 needs to be replaced or modified to meet the new signal requirements. No changes are required at universal controller 502 or other interface controllers.

What is claimed is:

1. A computerized wagering gaming system comprising:

a universal game control system operable to control a plurality of different computerized wagering games including a plurality of different video based games without moving mechanical parts and different games with moving mechanical parts such as wheels or reels;

the control system comprising a controller interface and a universal controller for processing game and operating system instructions for said plurality of different games;

a plurality of game system devices; and a game translator system for translating game events between the system devices and the universal game control system, the game translator system comprising a plurality of device drivers and receivers linked to the system devices by a first bus;

a second bus linking the translator system to the controller interface and a third bus linking the controller interface to the universal controller;

wherein the same translator system being configured for either a plurality of different video based games or a plurality of different games with moving mechanical parts; and wherein to convert the gaming system from one video based game to another video based game or from one game with a moving part to another game with a moving part, only the system devices need be changed and to convert the gaming system from one video based game to a game with a moving part or vice versa, the game translator system would need to be changed or modified along with the system devices.

2. The system of claim 1, wherein the controller interface further comprises an address decoder.

3. The system of claim 1, wherein the controller interface further comprises nonvolatile random access memory.

4. The system of claim 1, wherein the controller interface further comprises read only memory for storing gaming system programs.

5. The system of claim 1, wherein the controller interface further comprises an identification module, having an identifier unique to the gaming system.

6. The system of claim 5, wherein the identification module is a silicon serial number.

7. The system of claim 1, wherein the universal game control system further comprises a game operating system controller, including read only memory for storing gaming system operating system programs.

8. The system of claim 7, wherein the game operating system controller further comprises flash memory for storing a gaming program unique to the gaming system.

9. The system of claim 1, wherein the universal controller further comprises flash memory for storing a gaming program unique to the gaming system.

10. The system of claim 1, wherein the flash memory includes a removable memory card.

11. The system of claim 1, wherein the second bus is a logic communication bus for handling logic level signals between the controller interface and the translator interface.

12. The system of claim 11, the gaming devices including a first gaming device having a game event signal type, and the game translator system operates to translate the game event between the logic level signals and the game event signal type.

13. The system of claim 12, wherein the game translator system includes a driver/receiver module for operating to translate the game event between the logic level signal and the event signal type.

14. The system of claim 13, wherein the driver/receiver module is a voltage converter.

15. The system of claim 1, wherein the gaming system is a mechanical reel-based slot machine; having a location sensor device and a mechanical reel device; and wherein the game translator system includes a receiver for handling game events associated with the location sensor device and a driver for handling game events associated with the mechanical reel device.

16. A computerized wagering gaming system comprising:

a universal computerized game system operable to control a plurality of different computerized wagering games, including a plurality of different video based games without moving mechanical parts and different games with moving mechanical parts such as wheels or reels;

the control system comprising a controller interface and a universal controller for processing game and operating system instructions for said plurality of different games;

a plurality of game system devices;

a game translator system, the game translator system comprising a translator interface and a plurality of device drivers and receivers linked to at least some of the devices by a first bus;

a second bus linking the translator interface to the controller interface, a third bus linking the controller interface to the universal controller; and a fourth bus directly linking at least one device to the universal controller;

wherein the game translator system being configured for either a plurality of different video based games or a plurality of different games with moving mechanical parts, and wherein to convert the gaming system from one video based game to another video based game or from one game with a moving part to another game with a moving part, only the system devices need be changed and to convert the gaming system from one video based game to a game with a moving part or vice versa, the game translator system would need to be changed or modified along with the system devices.

17. A method for reconfiguring a computerized wagering game apparatus having a harness for associating memory with output devices in the apparatus, the method comprising:

removing an original special-purpose computerized game controller used to control a computerized wagering game from the apparatus, the original computerized game controller designed to and capable of working exclusively with a particular computerized wagering game apparatus;

installing a universal game control system operable to control a plurality of different computerized wagering games including a plurality of different video based games without moving mechanical parts and a plurality of games with moving mechanical parts such as wheels or reels, the control system comprising a controller interface and a universal controller for processing game and operating system instructions for said plurality of different games, a game translator system for translating game events between the output devices and the universal game control system, the game translator system comprising a plurality of device drivers and receivers linked to the output devices by a first bus, a second bus linking the translator system to the controller interface and a third bus linking the controller interface to the universal controller, wherein the game translator system being configured for either a plurality of different video based games or a plurality of different games with moving mechanical parts;

converting the gaming system from one video based game to another video based game or from one game with a moving part to another game with a moving part by changing only the output devices; and converting the gaming system from one video based game to a game with a moving part or vice versa by changing or modifying the game translator system and the output devices.

18. A process for modifying game controls in a casino wagering system comprising:

removing a motherboard from a gaming apparatus comprising a housing, a monitor, a motherboard comprising memory for executing game rules and game rules; and replacing the mother board with a universal game control system operable to control a plurality of different computerized wagering games including a plurality of different video based games without moving mechanical parts and a plurality of games with moving mechanical parts such as wheels or reels, the control system comprising a controller interface and a universal controller for processing game and operating system instructions for said plurality of different games, a game translator system for translating game events between the output devices and the universal game control system, the game translator system comprising a plurality of device drivers and receivers linked to the output devices by a first bus, a second bus linking the translator system to the controller interface and a third bus linking the controller interface to the universal controller, wherein the game translator system being configured for either a plurality of different video based games or a plurality of different games with moving mechanical parts.

19. The process of claim 18, further comprising operating the casino wagering system.

20. The process of claim 18, further comprising playing an existing game on the casino wagering system.

21. The process of claim 18, further comprising operating the game via a gaming operating system on the universal computerized game system, using existing gaming system devices.

* * * * *

UNITED STATES PATENT AND TRADEMARK OFFICE

CERTIFICATE OF CORRECTION

PATENT NO. : 6,866,581 B2
DATED : March 15, 2005
INVENTOR(S) : Michael G. Martinek et al.

It is certified that error appears in the above-identified patent and that said Letters Patent is hereby corrected as shown below:

Column 26,
Line 1, please delete “same” and replace with -- game --.

Column 27,
Line 8, please delete “controller;” and replace with -- controller, --.

Signed and Sealed this

Twentieth Day of September, 2005

JON W. DUDAS
*Director of the United States Patent and Trademark Office*